US012594452B2

(12) United States Patent
Dyer

(10) Patent No.: US 12,594,452 B2
(45) Date of Patent: Apr. 7, 2026

(54) SELECTIVELY WEIGHTED FITNESS SLIDER

(71) Applicant: Carl Dyer, Sugarland, TX (US)

(72) Inventor: Carl Dyer, Sugarland, TX (US)

( * ) Notice: Subject to any disclaimer, the term of this patent is extended or adjusted under 35 U.S.C. 154(b) by 291 days.

(21) Appl. No.: 18/237,697

(22) Filed: Aug. 24, 2023

(65) Prior Publication Data

US 2024/0082618 A1 Mar. 14, 2024

Related U.S. Application Data

(60) Provisional application No. 63/405,195, filed on Sep. 9, 2022.

(51) Int. Cl.
*A63B 21/06* (2006.01)

(52) U.S. Cl.
CPC ..... *A63B 21/0618* (2013.01)

(58) Field of Classification Search
CPC ..... A63B 21/0618; A63B 22/20
See application file for complete search history.

(56) References Cited

U.S. PATENT DOCUMENTS 7,553,267 B1 * 6/2009 Hauser ..... A63B 21/4049 482/141
8,702,574 B2 * 4/2014 Abranchess ..... A63B 23/1209 482/141
10,773,119 B2 * 9/2020 Cheng ..... A63B 23/1236
11,318,352 B2 * 5/2022 DeCesare ..... A63B 23/03541
2014/0100090 A1 * 4/2014 Lima ..... A63B 23/1236 482/139
2017/0296864 A1 * 10/2017 Richter ..... A63B 21/072
2017/0312568 A1 * 11/2017 DeCesare ..... A63B 71/0622
2019/0030387 A1 1/2019 Ferdinandsen, II
2019/0358482 A1 * 11/2019 Huneau ..... A63B 21/0004
2020/0289892 A1 * 9/2020 DeCesare ..... A63B 23/03541
2022/0184453 A1 * 6/2022 Elpers ..... A63B 21/4034
2022/0280829 A1 * 9/2022 Gamboa ..... A63B 21/0728
2022/0331661 A1 * 10/2022 Zimmer ..... A63B 22/20

* cited by examiner

*Primary Examiner* — Zachary T Moore
(74) *Attorney, Agent, or Firm* — McCutcheon Joseph, PLLC

(57) ABSTRACT

A selectively weighted fitness slider includes a base, an interior space within the base, an inner wall in the interior space that extends from the base, and a top part that is releasably attached to the base. A locking band encircles the base and top part to releasably secure the base and top part together. The inner wall releasably secures a weight within the interior space. The weight can be secured by the inner wall, which is configured to secure the weight via an inside surface of the inner wall or an outside surface of the inner wall. The fitness slider may have a first weight inside the inner wall, a second weight outside of the inner wall, and a third weight surrounding the second weight. The fitness slider allows a person to add different weight combinations to adjust the resistance of the fitness slider and meet his/hers individual needs.

14 Claims, 22 Drawing Sheets

SELECTIVELY WEIGHTED FITNESS SLIDER

CROSS REFERENCE TO RELATED APPLICATIONS

This application is a non-provisional application that claims priority to U.S. Provisional Application No. 63/405,195, filed on Sep. 9, 2022. The disclosure of the prior application is hereby incorporated by reference herein in its entirety.

TECHNICAL FIELD

The present disclosure relates to a fitness device that is slid on a surface to perform an exercise routine. In particular, the present disclosure relates to a fitness slider having a configuration with which one or more weights of different sizes can be placed within the fitness slider to selectively increase a sliding resistance of the fitness slider on the surface.

BACKGROUND

Some physical fitness exercises are performed with disc-shaped devices that slide on a floor. The devices, known as "sliders" have a low-friction bottom surface that slides against the floor, and an opposing top surface that is gripped by the hands, arms, legs or feet of a person. The person may place one of those body parts on the slider and perform an exercise in which the body part moves with the slider along the floor. The slider thus allows the person to perform floor exercises with sliding movements of the hands, arms, legs or feet while maintaining contact with the floor. These exercises can improve the person's balance, range of motion, and muscular strength.

SUMMARY

It may be desirable to increase the intensity of an exercise that implements a fitness slider. One way to increase the intensity is to increase the weight of fitness slider. Increasing the weight of the fitness slider can increase the resistance with which the fitness slider slides along the floor, making the fitness slider somewhat less easy to move along the floor. The increased resistance can provide the person with a more rigorous exercise and increase the effectiveness of the exercise routine. Conventional fitness sliders have not provided the ability to selectively add different weight combinations to the fitness slider to meet the individual needs or desires of a given person using the fitness slider to perform exercise routines.

The present disclosure describes a selectively weighted fitness slider that is configured to allow a person to choose different weight combinations to add to the fitness slider to adjust the resistance of the fitness slider and meet the individual resistance needs or desires of a person using the fitness slider to perform exercise routines. The present disclosure also describes a method of assembling a fitness slider which accommodates the addition of different weight combinations in the fitness slider to adjust the resistance of the fitness slider. The present disclosure further describes a fitness kit that includes a fitness slider and one or more weight combinations that can be selectively secured within the fitness slider to adjust the resistance of the fitness slider. The present disclosure thus describes a selectively weighted fitness slider, method, and kit that can selectively increase the intensity and resistance of an exercise routine according to the individual person's needs or desires with respect to the exercise routine.

In one embodiment, a fitness slider comprises: a base; an interior space within the base; an inner wall provided in the interior space and extending from the base; and a top part that is releasably attached to the base, wherein the inner wall is configured to releasably secure a weight within the interior space.

In an embodiment, the fitness slider comprises a locking band that encircles the base and the top part to releasably secure the base and the top part together.

In an embodiment, the fitness slider comprises the weight secured by the inner wall.

In an embodiment, the inner wall is configured to secure the weight via an inside surface of the inner wall.

In an embodiment, the inner wall is configured to secure the weight via an outside surface of the inner wall.

In an embodiment, the fitness slider further comprises a first weight inside the inner wall, and a second weight outside of the inner wall.

In an embodiment, the fitness slider further comprises a third weight surrounding the second weight.

In an embodiment, the top part comprises a foam material on an outer surface of the top part.

In another embodiment, a method of assembling a fitness slider comprises: inserting a weight into an interior space of a base of the fitness slider; releasably securing the weight to an inner wall that is provided in the interior space and that extends from the base, by positioning the weight adjacent to one of an inside surface of the inner wall and an outside surface of the inner wall; and releasably attaching a top part of the fitness slider to the base to enclose the interior space.

In an embodiment, the method comprises positioning the weight adjacent to the inside surface of the inner wall.

In an embodiment, the method comprises positioning the weight adjacent to the outside surface of the inner wall.

In an embodiment, the method comprises positioning a second weight adjacent to the outside surface of the inner wall to releasably secure the second weight to the inner wall.

In an embodiment, the method comprises positioning a third weight in the interior space to surround the second weight.

In an embodiment, the method comprises positioning a second weight in the interior space to surround the weight that is adjacent to the outside surface of the inner wall.

In an embodiment, the method comprises positioning a second weight in the interior space adjacent to an inside surface of a shoulder of the base.

In an embodiment, the method comprises releasably securing the top part of the fitness slider to the base by encircling the base and the top part with a locking band.

In a further embodiment, a fitness kit comprises: a fitness slider comprising: a base; an interior space within the base; an inner wall provided in the interior space and extending from the base; and a top part that is releasably attachable to the base; a locking band that encircles the base and the top part to releasably secure the base and the top part together; and one or more weights configured to be releasably secured within the interior space of the fitness slider, wherein the inner wall of the slider is configured to releasably secure at least one of the one weights via contact with one of an outside surface of the inner wall and an inside surface of the inner wall.

In an embodiment, an inner surface of a shoulder of the base is configured to releasably secure one of the one or more weights via contact with an inner surface of the shoulder.

In an embodiment, the fitness kit comprises a first one of the one or more weights configured to fit inside the inner wall, and a second one of the one or more weights configured to fit outside of the inner wall.

In an embodiment, the fitness kit further comprises a third one of the one or more weights configured to surround the second weight.

BRIEF DESCRIPTION OF THE FIGURES

The summary above, as well as the following detailed description of illustrative embodiments, is better understood when read in conjunction with the appended drawings. For the purpose of illustrating the present disclosure, exemplary constructions of the disclosure am shown in the drawings. However, the disclosure is not limited to specific methods and instrumentalities disclosed herein.

DETAILED DESCRIPTION

Figure 1:
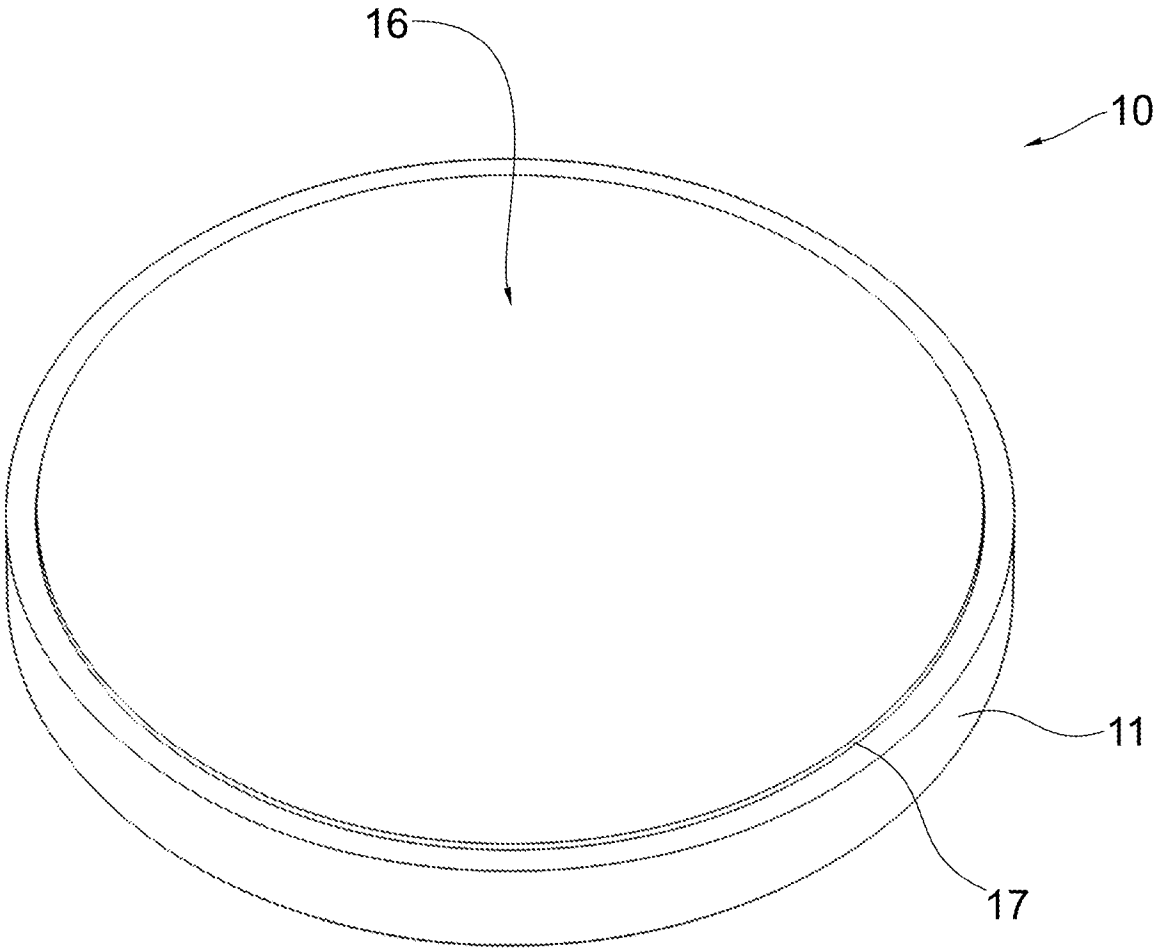
FIG. 1 is a perspective view of an assembled selectively weighted fitness slider according to an embodiment.

While processes, systems and devices are described herein by way of examples and embodiments, those skilled in the art recognize the processes, systems and devices are not limited to the embodiments or drawings described. It should be understood that the drawings and description are not intended to be limited to the particular form disclosed. Rather, the intention is to cover all modifications, equivalents and alternatives falling within the spirit and scope of the appended claims and description. Any headings used herein are for organization purposes only and are not meant to limit the scope of the description of the claims. As used herein, the word "may" is used in a permissive sense (i.e., meaning having the potential to) rather than the mandatory sense (i.e., meaning must). Similarly, the words "include," "including," and "includes" mean including, but not limited to. The present disclosure describes particular embodiments and with reference to certain drawings, but the subject matter is not limited thereto.

The present disclosure will provide description to the accompanying drawings, in which some, but not all embodiments of the subject matter of the disclosure are shown. Indeed, the subject matter may be embodied in many different forms and should not be construed as limited to the embodiments set forth herein, rather, these embodiments are provided so that this disclosure satisfies all the legal requirements. The disclosure herein is illustrative and explanatory of one or more embodiments and variations thereof, and it will be appreciated that various changes in the design, organization, means of operation, structures and location, methodology, and use of mechanical equivalents may be made without departing from the spirit of the invention. Because many varying and different embodiments may be made within the scope of the concept(s) herein taught, and because many modifications may be made in the embodiments described herein, it is to be understood that the details herein are to be interpreted as illustrative and non-limiting.

Certain terminology is used in the following description for convenience only and is not limiting. Certain words used herein designate directions in the drawings to which reference is made. Unless specifically set forth herein, the terms "a," "an" and "the" are not limited to one element, but instead should be read consistent with the meaning of "one or more," "at least one," and "one or more than one." As used herein "another" means at least a second or more. The terminology includes the words noted above, derivatives thereof and words of similar import.

Unless otherwise defined, all technical terms used herein have the same meaning as commonly understood by one of ordinary skill in the art.

FIG. 1 illustrates one embodiment of a selectively weighted fitness slider 10 in an assembled state. The selectively weighted fitness slider 10 is formed of a base 12 (see FIGS. 2 and 5), a top part 16 that is releasably attachable to the base 12, and a locking band 11 that secures the base 12 to the top part 16. The base 12 and the top part 16 may be formed of thermoplastic polymer material, such as high density polyethylene (HDPE) or another suitable polymer material. However, the base 12 and the top part 16 are not limited to being formed of this material, and in other embodiments may be formed of resin, polyamide (e.g., nylon), polycarbonate (e.g., BPA), polypropylene or polyethylene. In further embodiments, the base 12 and the top part 16 may be formed of a light-weight hard plastic material made from Acrylonitrile butadiene styrene (ABS) that facilitates the sliding motion against a surface of wood, fiber, carpet, tile, ceramic, plastic, metal, concrete, stone, or a synthesize composite. The top part 16 may include a foam material 17 on the outer surface of the top part 16. The foam material 17 may be formed of natural or synthetic fabric, or any other suitable soft material, that acts as a buffer for sliding on tile or wood floors so that the selectively weighted fitness slider 10 glides smoothly across the tile or wood floor without scratching the surface. Meanwhile, the thermoplastic polymer material of the base 12 (without the foam) allows for easy sliding on grass, turf, carpet, or other fiber flooring. The locking band 11 encircles the base 12 and the top part 16 to secure the base 12 and the top part 16 from being separated from each other, as discussed in further detail below. The locking band 11 is removable from the base 12 and the top part 16, such that the base 12 and the top part 16 can be separated from each other, when the locking band 11 is removed. The locking band 11 may be formed of a polyurethane material or a rubber material. The material of the locking band 11 may be somewhat flexible and/or stretchable so as to function as a tight rubber band that can both secure the base 12 together with the top part 16, and be removed from around the base 12 and top part 16 to disassemble the selectively weighted fitness slider 10.

In the illustrated embodiment, the selectively weighted fitness slider 10 may have a substantially circular shape, such that the selectively weighted fitness slider 10 is substantially disc-shaped. However, other polygonal shapes (e.g., rectangular, pentagonal, hexagonal, etc.) are within the scope of the present disclosure, and other such shapes will not materially alter the function and purpose of the selectively weighted fitness slider 10. In one embodiment, the top part 16 may have a diameter of 9 inches and a thickness of 0.31 inches. The base 12 may have a diameter of 9 inches and a thickness of 0.31 inches. The locking band 11 may have a height of 1 inch and thickness of 0.25 inches. However, the selectively weighted fitness slider 10 is not limited to these dimensions, and larger and smaller dimensions are within the scope of the present disclosure.

Figure 2:
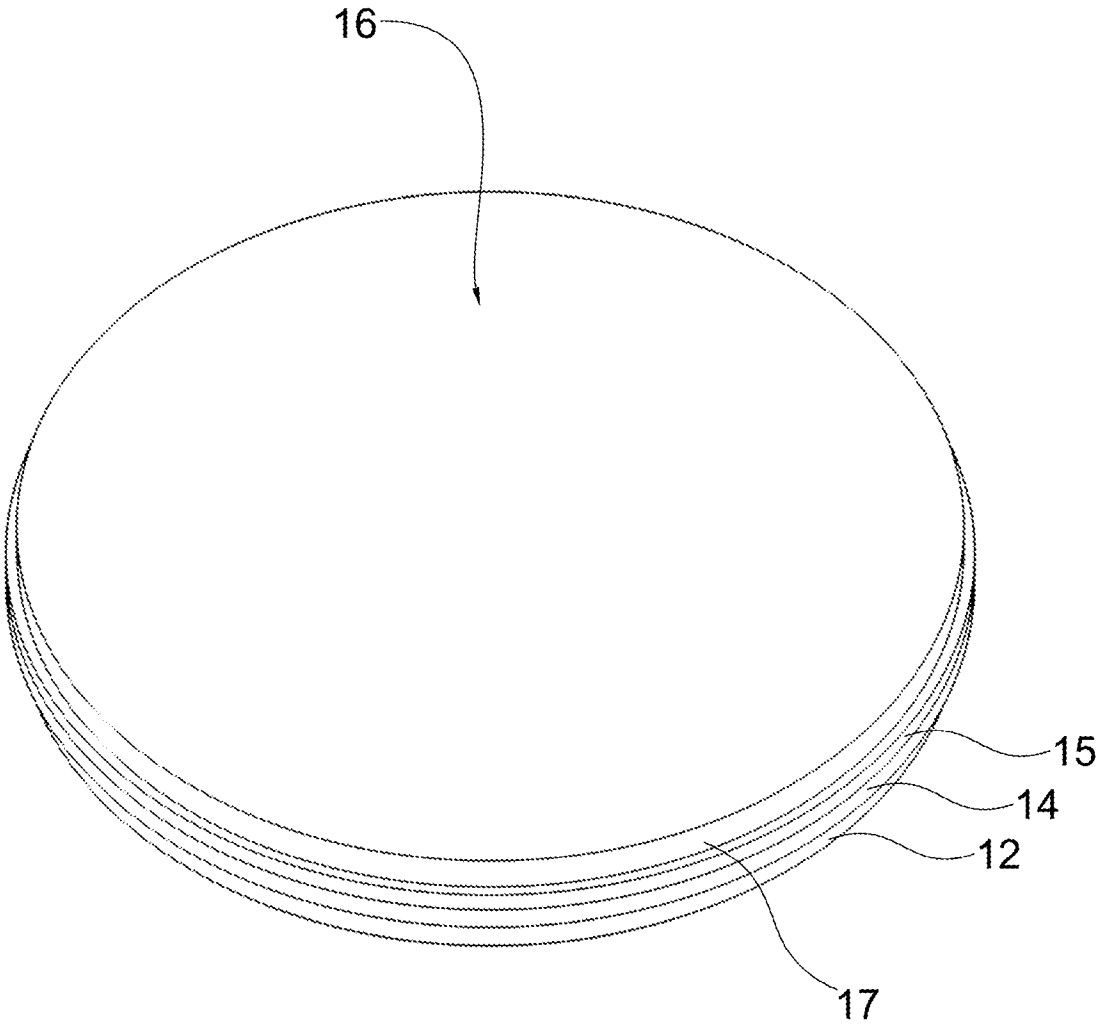
FIG. 2 is a perspective view of a partially assembled selectively weighted fitness slider with the locking band removed according to an embodiment.

FIG. 2 is a perspective view of a partially assembled selectively weighted fitness slider 10 with the locking band 11 removed according to an embodiment. The illustrated embodiment shows that the top part 16 includes a shoulder 15 that protrudes radially from the top part 16. Similarly, the base 12 includes a shoulder 14 that protrudes radially from the base 12. As discussed below, the shoulder 15 of the top part 16 includes a connector for engaging with a corresponding connector of the shoulder 14 of the base 12. Such connectors, discussed in further detail below, may prevent lateral movement of the top part 16 and the base 12 relative to each other, but not vertical movement of the top part 16 relative to (e.g., away from) the base 12. The locking band 11 prevents vertical movement of the top part 16 relative to (e.g., away from) the base 12 when the locking band 11 is disposed around the engaged top part 16 and base 12.

Figure 3:
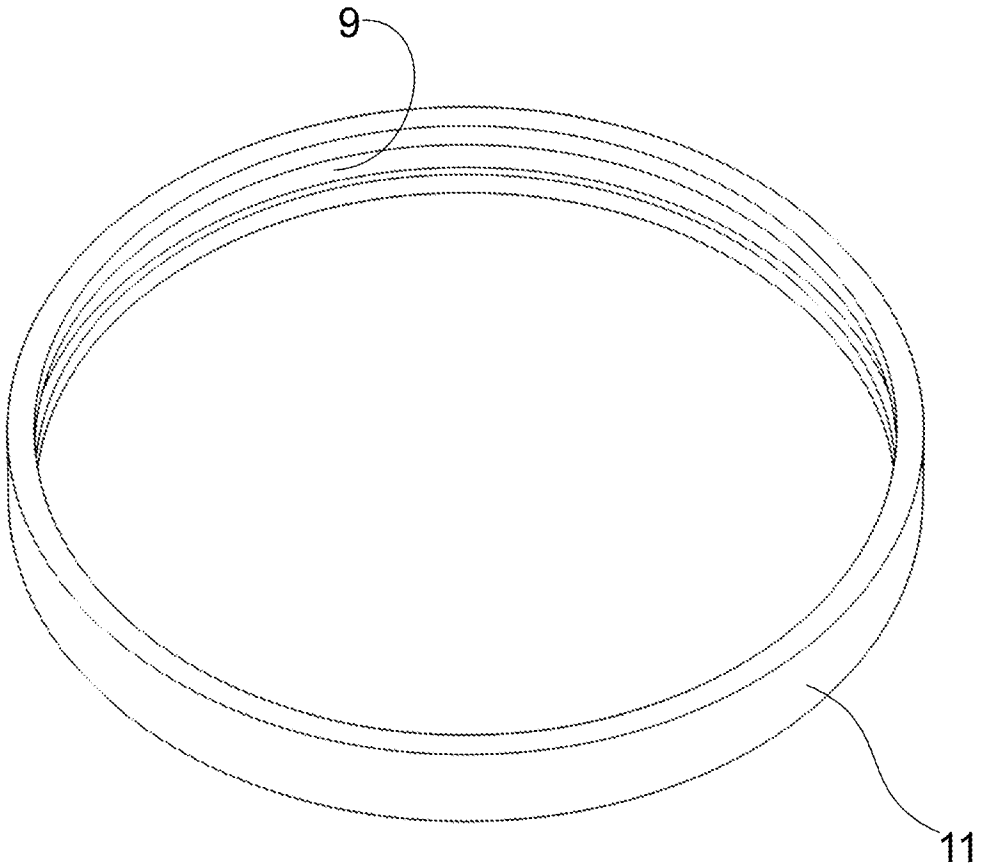
FIG. 3 is a perspective view of the locking band of the selectively weighted fitness slider according to an embodiment.

In particular, the locking band 11 includes an inner groove 9 around an inner circumference of the locking band 11 as shown in the perspective view of the locking band 11 illustrated in FIG. 3. The inner groove 9 is configured to fit therein the joined shoulders 14, 15 of the base 12 and the top part 16, respectively. The inner groove 9 prevents the joined shoulders 14, 15 from becoming vertically (and laterally) separated from each other, as discussed further detail below, when the locking band 11 is disposed around the engaged top part 16 and base 12.

Figure 4:
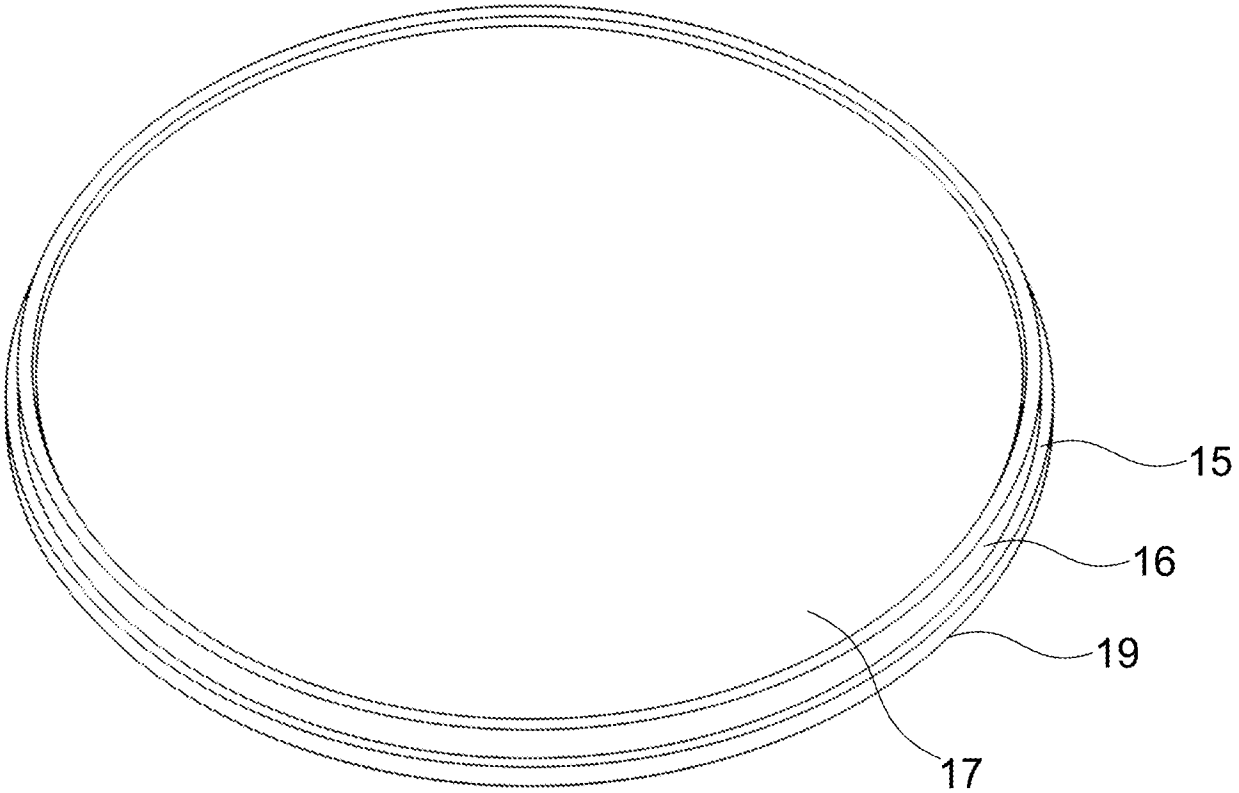
FIG. 4 is a perspective view of the top part of the selectively weighted fitness slider according to an embodiment.

FIG. 4 illustrates an isolated perspective view of the top part 16 of the selectively weighted fitness slider 10 according to an embodiment. As discussed above, the top part 16 may include a foam material 17 on the outer surface of the top part 16, which acts as a buffer for sliding on tile or wood floors so that the selectively weighted fitness slider 10 glides smoothly across the tile or wood floor without scratching the surface. FIG. 4 shows that the shoulder 15 of the top part 16 includes a male connector 19 that protrudes vertically away from the shoulder 15. The male connector 19 is configured to engage with a female connector 8 on the shoulder 14 of the base 12 (see FIGS. 5 and 13). The engaged female and male connectors 8, 19 may prevent lateral movement of the top part 16 and the base 12 relative to each other.

Figure 5:
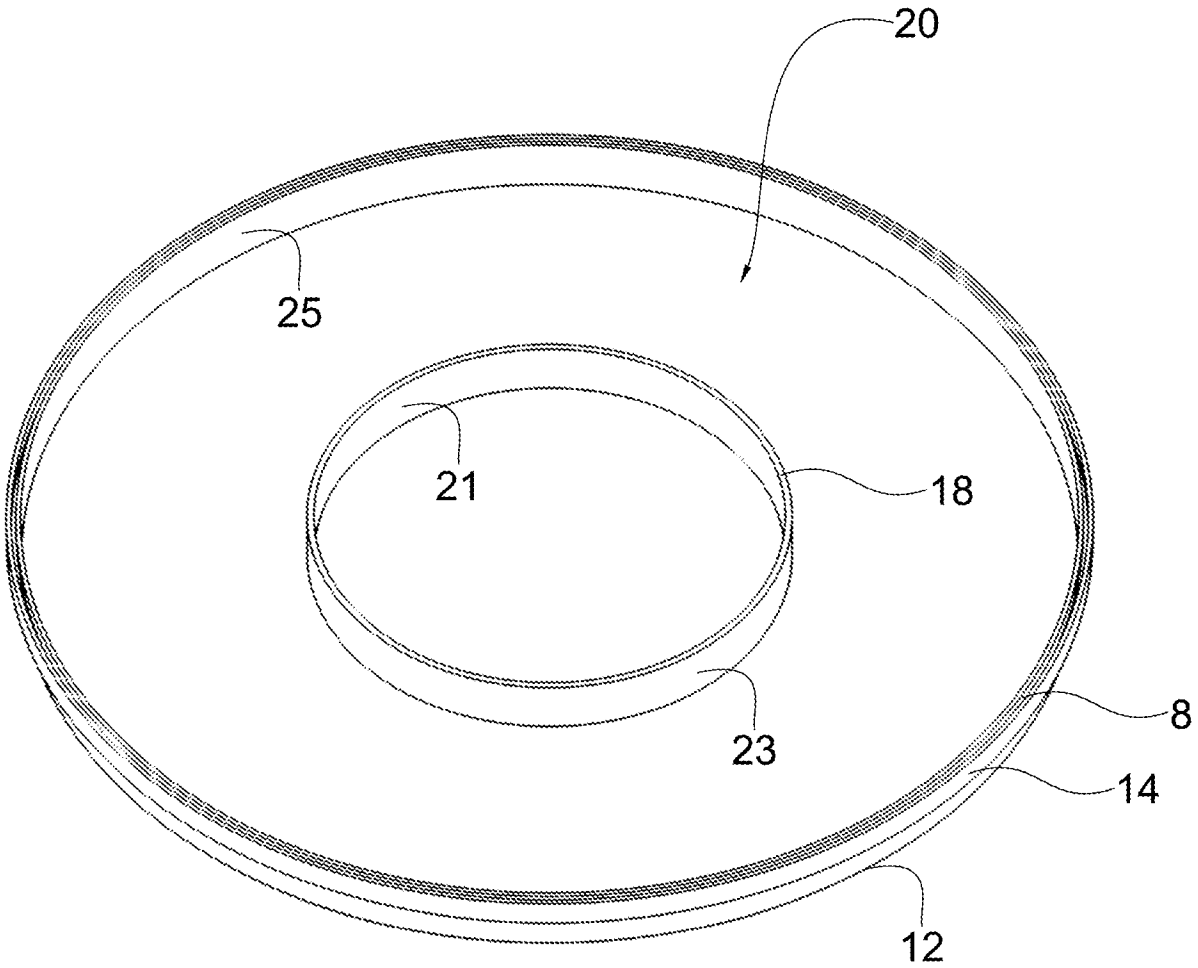
FIG. 5 is a perspective view of the base of the selectively weighted fitness slider according to an embodiment.

FIG. 5 is an isolated perspective view of the inner portion of the base 12 of the selectively weighted fitness slider 10 according to an embodiment. FIG. 5 shows that the base 12 defines an interior space 20 within the selectively weighted fitness slider 10 such that the interior space 20 is surrounded by the shoulder 14. FIG. 5 also shows that the shoulder 14 includes the female connector 8 that extends in the shoulder 14 circumferentially around the base 12. In this embodiment, the female connector 8 is a groove or recess that is configured to fit therein the male connector 19 on the shoulder 15 of the top part 16. The shoulder 14 further includes an inner surface 25 facing the interior space 20. The base 12 includes an inner wall 18 that is provided in the interior space 20 and that extends from the base 12 as shown in the FIG. 5. In the illustrated embodiment, the inner wall 18 includes an outside surface 23 facing the inner surface 25 of the shoulder 14, and an opposing inside surface 21. The inner wall 18 may be formed of the same material as the base 12 and/or the top part 16, and may have a diameter of 4.5 inches and a height of 0.5 inches. However, the inner wall 18 is not limited to these dimensions, and larger and smaller dimensions are within the scope of the present disclosure. The inner wall 18 is configured to releasably secure one or more weights (see FIGS. 6 and 7) within the interior space 20, in order to selectively increase or decrease the overall weight of the selectively weighted fitness slider 10, so as to increase or decrease the intensity and resistance of an exercise routine according to the individual person's needs or desires with respect to the exercise routine.

Figure 6:
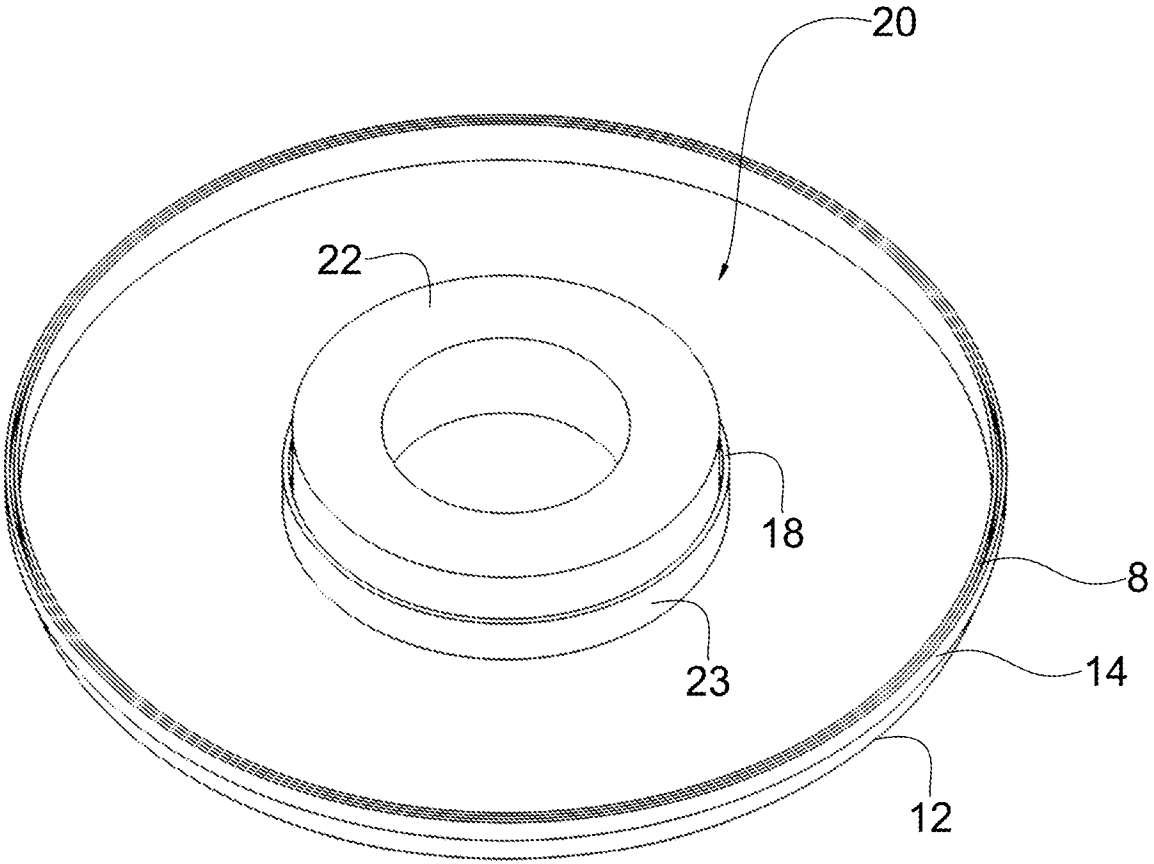
FIG. 6 is a perspective view of the base of the selectively weighted fitness slider including a first weight, according to an embodiment.

FIG. 6 is a perspective view of the inner portion of the base 12 showing a first weight 22 provided in the interior space 20. In this case, the first weight 22 is located inside the inner wall 18, so as to be secured within the interior space 20 via contact with the inside surface 21 of the inner wall 18. That is, the first weight 22 is secured from moving within the interior space 20 by being confined by the inside surface 21 of the inner wall 18. The first weight 22 may be a 2 pound weight that can be placed within the base 12 to increase the overall weight of the selectively weighted fitness slider 10, so as to increase the intensity and resistance of an exercise routine according to the individual person's needs or desires with respect to the exercise routine. The height of the inner wall 18 may be less than that of the first weight 22 so that the inner wall 18 does not interfere with a person's fingers and thumb grasping the first weight 22 when the person places the first weight 22 inside the inner wall 18 or retrieves the first weight 22 from inside the inner wall 18. The first weight 22 may be a ring-shaped plate with a circular opening in the center thereof.

Figure 7:
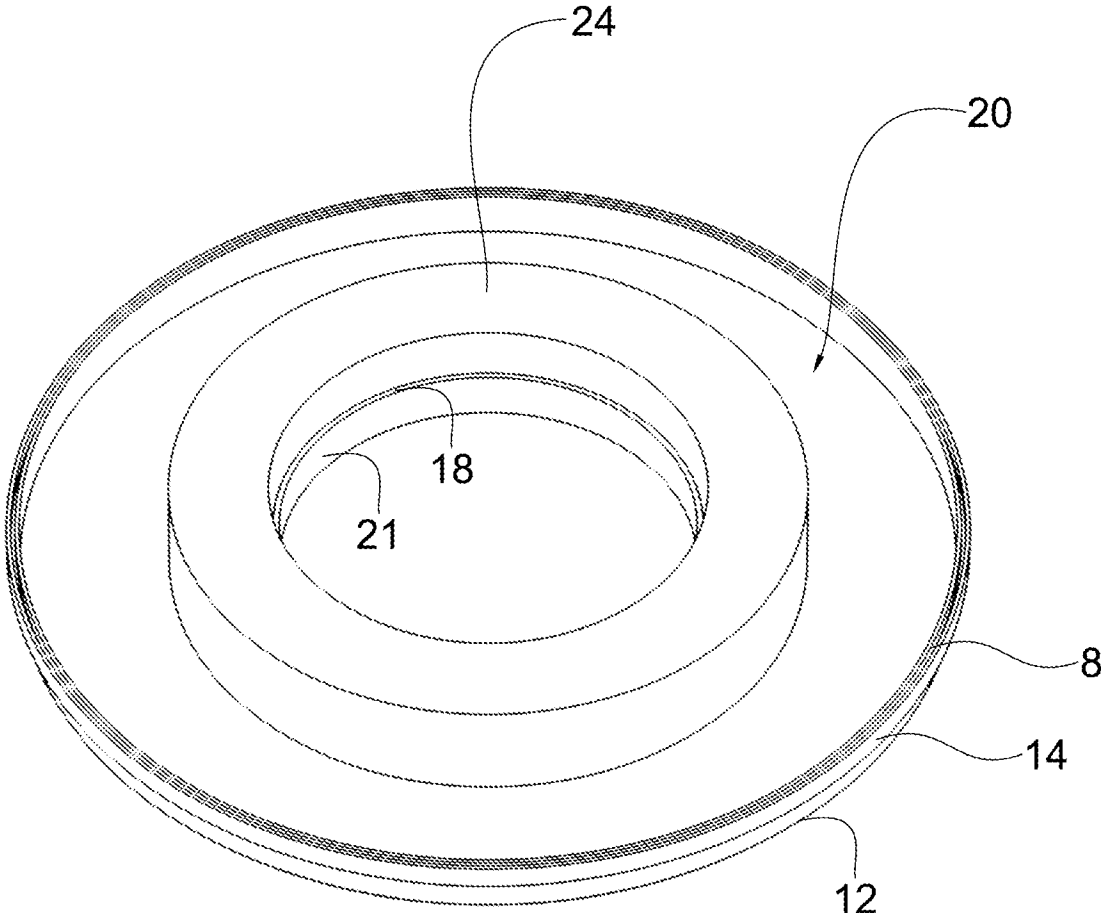
FIG. 7 is a perspective view of the base of the selectively weighted fitness slider including a second weight, according to an embodiment.

FIG. 7 is another perspective view of the inner portion of the base 12. This view shows a second weight 24 provided in the interior space 20. The second weight 24 is located outside the inner wall 18, so as to be secured within the interior space 20 via contact with the outside surface 23 of the inner wall 18. That is, the second weight 24 may be a ring-shaped plate with a circular opening in the center thereof, so as to be secured from moving within the interior space 20 via contact of the circular opening with the outside surface 23 of the inner wall 18. The second weight 24 may be a 3 pound weight that can be used by itself, or in addition with the 2 pound first weight 22 provided inside the inner wall 18, to increase the overall weight of the selectively weighted fitness slider 10. For instance, adding the 3 pound second weight 24 by itself would add three pounds to the overall weight of the selectively weighted fitness slider 10, while adding the 3 pound second weight 24 with the 2 pound first weight 22 would add five pounds to the overall weight of the selectively weighted fitness slider 10. Either combination can increase the intensity and resistance of an exercise routine according to the individual person's needs or desires with respect to the exercise routine.

Figure 8:
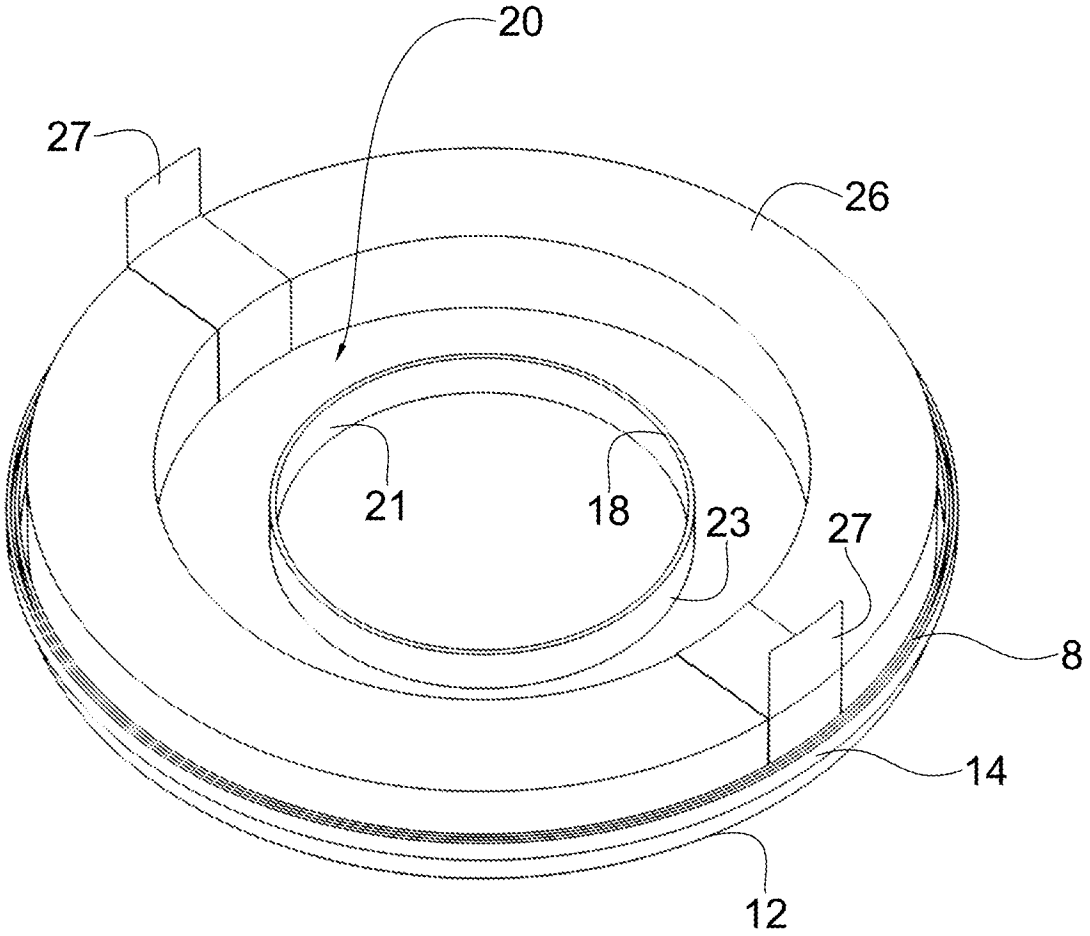
FIG. 8 is a perspective view of the base of the selectively weighted fitness slider including a third weight, according to an embodiment.
Figure 9:
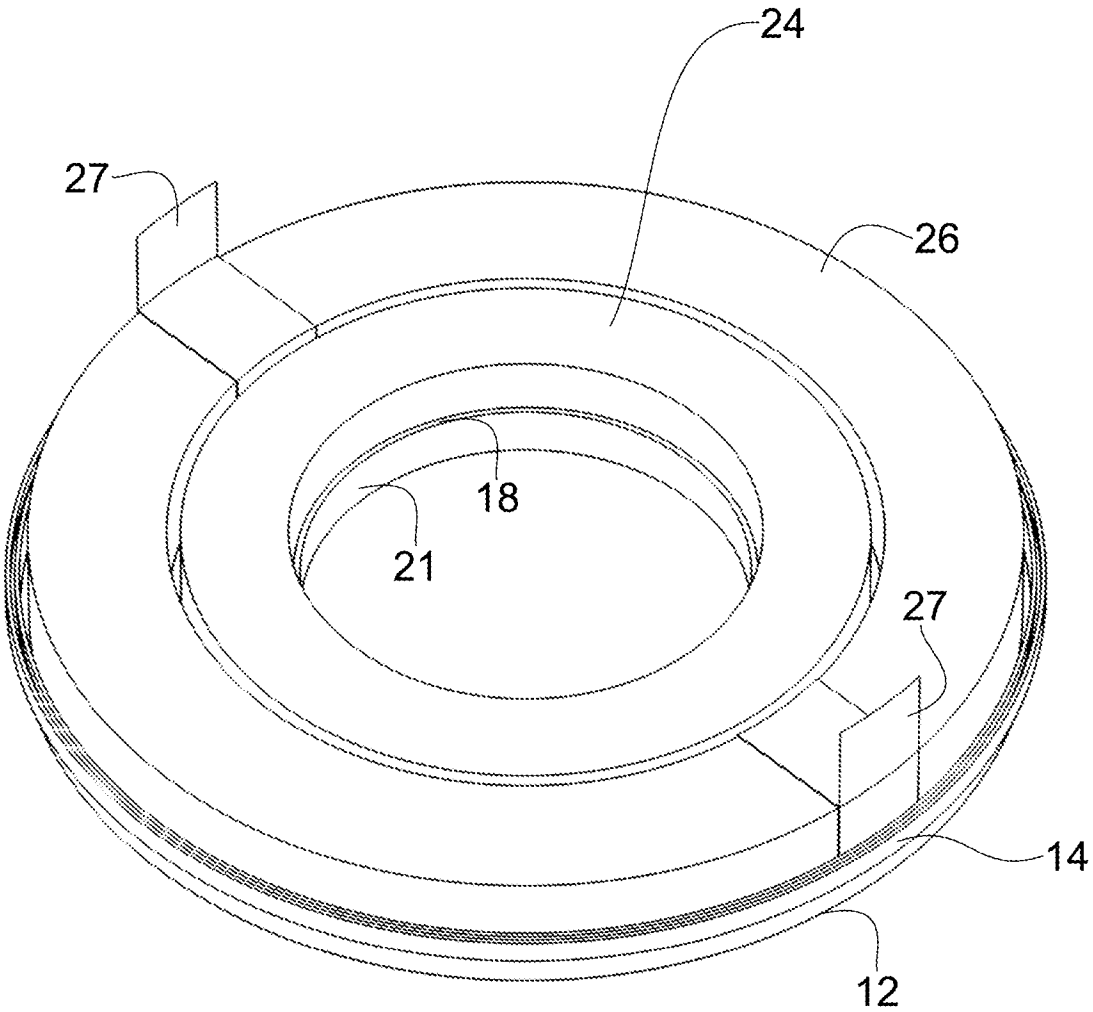
FIG. 9 is a perspective view of the base of the selectively weighted fitness slider including a combination of weights, according to an embodiment.
Figure 10:
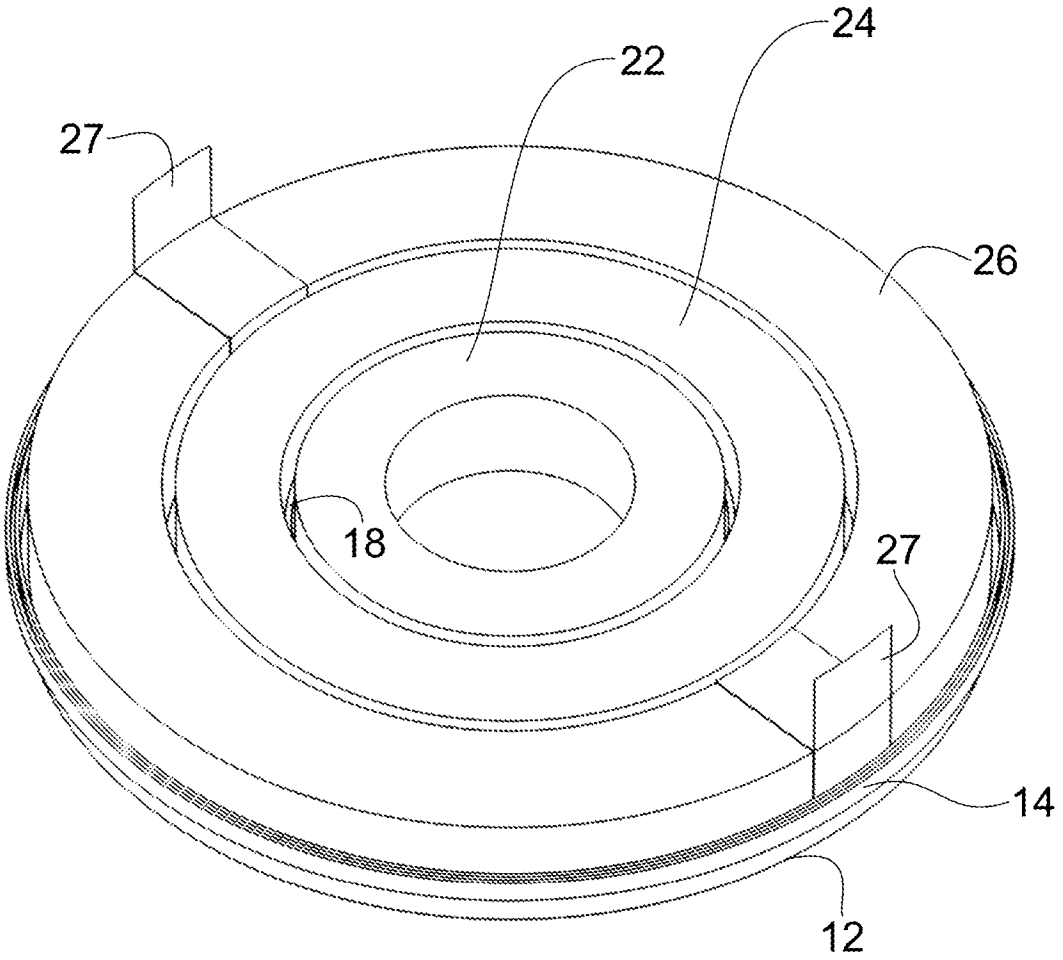
FIG. 10 is a perspective view of the base of the selectively weighted fitness slider including a first weight, and second weight, and a third weight, according to an embodiment.

FIG. 8 is a further perspective view of the inner portion of the base 12. This view shows a third weight 26 provided in the interior space 20. The third weight 26 is located within the interior space 20 and may be secured in within the interior space 20 via contact with the inner surface 25 of the shoulder 14. The third weight 26 may be a 5 pound weight that can be used by itself, or in addition with the 3 pound second weight 24 and/or 2 pound first weight 22, to increase the overall weight of the selectively weighted fitness slider 10. For instance, adding the 5 pound third weight 24 by itself would add five pounds to the overall weight of the selectively weighted fitness slider 10. In this case, the third weight 26 would be secured in within the interior space 20 via contact with the inner surface 25 of the shoulder 14. Adding the 5 pound third weight 26 with the 3 pound second weight 24, as shown in FIG. 9, would add eight pounds to the overall weight of the selectively weighted fitness slider 10. In this regard, the third weight 26 may be a ring-shaped plate with a circular opening in the center thereof, so as to surround the second weight 24 within the circular opening when used in combination with the second weight 24. Adding the 5 pound third weight 26 with the 3 pound second weight 24 and the 2 pound first weight 22, as shown in FIG. 10, would add ten pounds to the overall weight of the selectively weighted fitness slider 10. On the other hand, adding the 5 pound third weight 26 with the 2 pound first weight 22 would add seven pounds to the overall weight of the selectively weighted fitness slider 10. Any of these possible combinations can increase the intensity and resistance of an exercise routine according to the individual person's needs or desires with respect to the exercise routine. The material of the third weight 26, the second weight 24 and the first weight 22 is not particularly limiting, and in some embodiments may be iron, cast iron, or other metal. In some embodiments, the weights may be coated with a coating, such as a polyvinyl chloride sheath.

As shown in FIG. 8, the 5 pound third weight 26 may include one or more tabs 27 that are configured to assist the person with removing the third weight 26 from the interior space 20 of the base 12. The embodiment of FIG. 8 shows that the 5 pound third weight 26 includes two tabs 27 that are provided across from each other on opposite sides of the third weight 26. However, other embodiments may include only one tab 27, or three or more tabs 27 provided at locations around the third weight 26. Each tab 27 may be gripped by a finger and thumb of a person and pulled to lift the 5 pound third weight 26 from its position within the base 12. In one embedment, each tab 27 may be formed of tape that is attached to the third weight 26 via adhesive. The tape may wrap around the top, sides, and bottom of the third weight 26 as shown in FIG. 8. In other embodiments, each tab 27 may be formed if a flexible or bendable material that wraps around the top, sides, and bottom of the third weight 26. While FIG. 8 shows that the tabs 27 protrude from the top of the third weight 26, the tabs 27 may also protrude from the opposite (e.g., bottom) side of the third weight 26 so that the third weight 26 can be placed in the interior space 20 of the base 12 on the top or bottom side of the third weight 26. That is, each tab 27 shown in FIG. 8 protruding from the top of the 5 pound third weight 26 may have an opposite tab (not shown) on the bottom of the third weight 26. Such opposite tab would be folded under the third weight 26 in the interior space 20 of the base 12.

Figure 11:
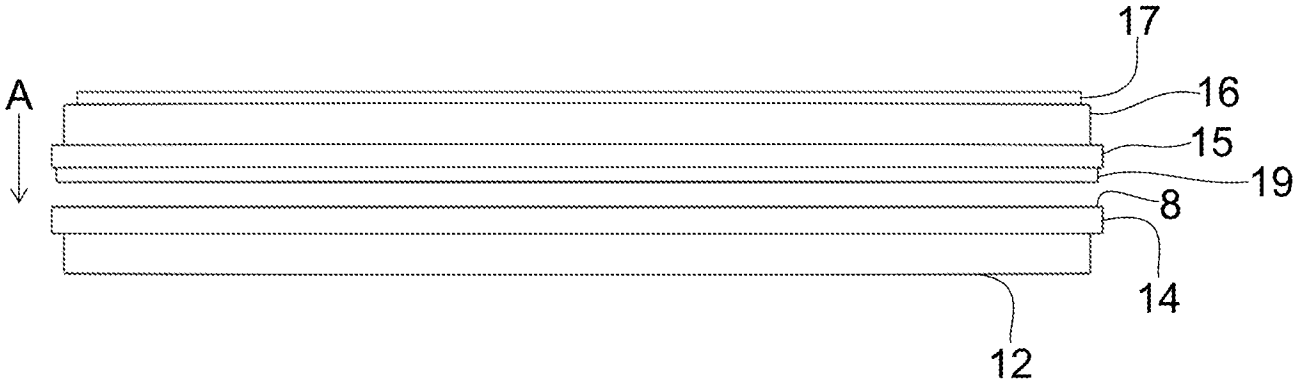
FIG. 11 is a side view of the top part and the base of the selectively weighted fitness slider according to an embodiment.

FIG. 11 is a side view of the top part 16 and the base 12 of the selectively weighted fitness slider 10 before engagement of the top part 16 and the base 12 via the male connector 19 on the shoulder 15 and the female connector 8 on the shoulder 14, according to an embodiment. FIG. 11 shows that to releasably attach the top part 16 of the selectively weighted fitness slider 10 to the base 12, the top part 16 and the base 12 are brought together in a vertical direction "A" so that the male connector 19 enters the female connector 8 (see FIG. 13).

Figure 12:
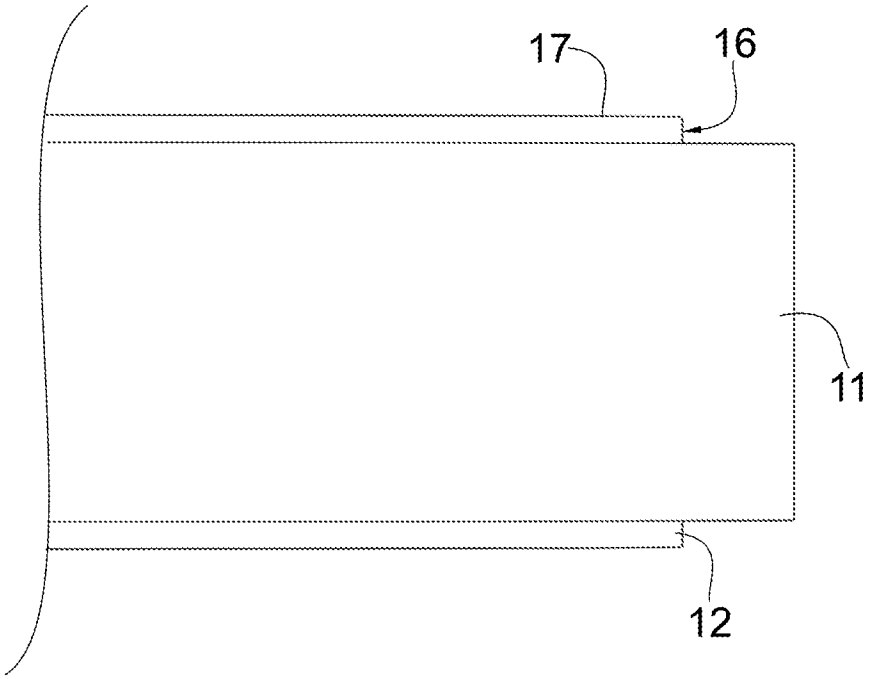
FIG. 12 is a close-up partial side view of the locking band, the top part, and the base of the assembled selectively weighted fitness slider according to an embodiment.
Figure 13:
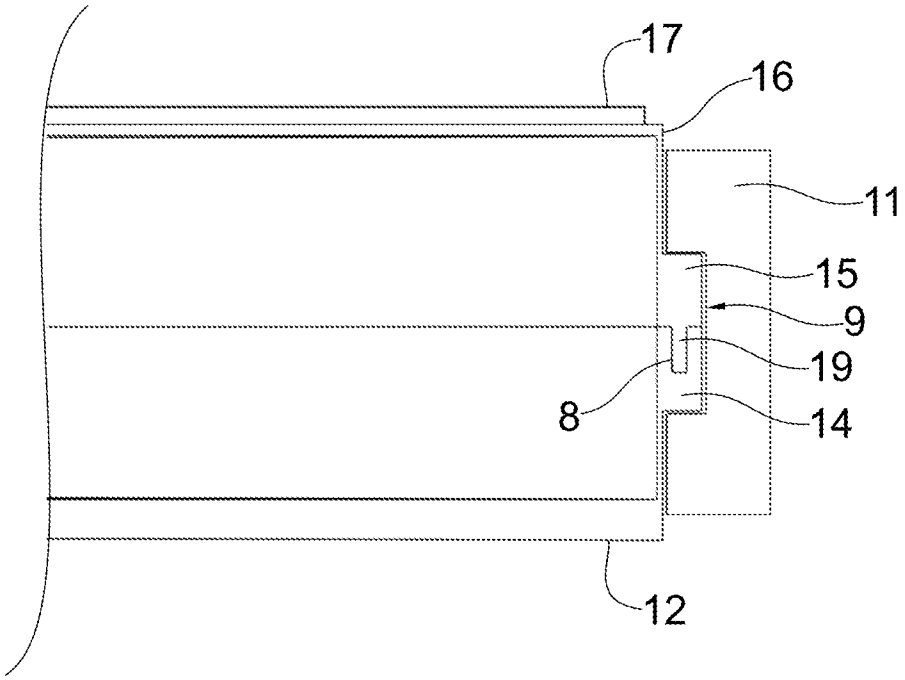
FIG. 13 is a cross-sectional view of the FIG. 12, showing engagement of the top part with the base, and engagement of the locking band with the top part and the base, according to an embodiment.

FIG. 12 is a close-up partial side view of the locking band 11 provided around the top part 16 and the base 12 of the assembled selectively weighted fitness slider 10 according to an embodiment. FIG. 13 is a cross-sectional view of the FIG. 12, showing details of the engagement of the top part 16 with the base 12, and engagement of the locking band 11 with the joined top part 16 and the base 12, according to an embodiment. As discussed above, the shoulder 14 of the base 12 includes a female connector 8 formed as a groove or recess that is configured to fit therein the male connector 19 on the shoulder 15 of the top part 16 when the top part 16 and the base 12 are brought together. The engaged female and male connectors 8, 19 may prevent lateral movement of the top part 16 and the base 12 relative to each other. Once the female and male connectors 8, 19 are engaged, the locking band 11 is then placed around the circumference of the partially assembled selectively weighted fitness slider 10 so that the joined shoulders 14, 15 of the base 12 and top part 16, respectively, fit into the inner groove 9 of the locking band 11 as shown in FIG. 13. The inner groove 9 secures the joined shoulders 14, 15 from becoming vertically (and laterally) separated from each other, so that the top part 16 is secured to the base 12. In this assembled state, the selectively weighted fitness slider 10 is ready for use.

A method of assembling a selectively weighted fitness slider 10 may include inserting a weight 22, 24 into the interior space 20 within the base 12, as discussed herein. The weight 22, 24 may be releasably secured to the inner wall 18 that is provided in the interior space 20 and that extends from the base 12, by positioning the weight 22, 24 adjacent to one of the inside surface 21 of the inner wall 18 and an outside surface 23 of the inner wall 18, as discussed herein. Or, a weight 26 may be releasably secured in the interior space 20 by positioning the weight 26 adjacent to the inner surface 25 of the shoulder 14, as discussed herein. The top part 16 of the selectively weighted fitness slider 10 may then be releasably attached to the base 12 to enclose the interior space 20, as discussed herein. The method may include positioning a first weight 22 adjacent to the inside surface 21 of the outer wall 14, and positioning a second weight 24 adjacent to the outside surface 23 of the inner wall 18 to releasably secure the first and second weights 22, 24 to the inner wall 18, as discussed herein. The method may also include positioning a third weight 16 in the interior space 20 to surround the second weight 24, as discussed herein. The method may further include releasably securing the top part 16 of the fitness slider 10 to the base 12 by encircling the base 12 and the top part 16 with a locking band 11, as discussed herein.

In some embodiments, the selectively weighted fitness slider 10 may be provided as a kit that includes the base 12, the top part 16 and the locking band 11, as discussed herein, along with the first, second and third weights 22, 24, 26 that are configured to be releasably secured within the interior space 20 of the selectively weighted fitness slider 10, as discussed herein. A person may use the first, second and third weights 22, 24, 26 with the selectively weighted fitness slider 10 in any of the different weight combinations as discussed herein to increase the intensity and resistance of an exercise routine according to the individual person's needs or desires with respect to the exercise routine.

Figure 14:
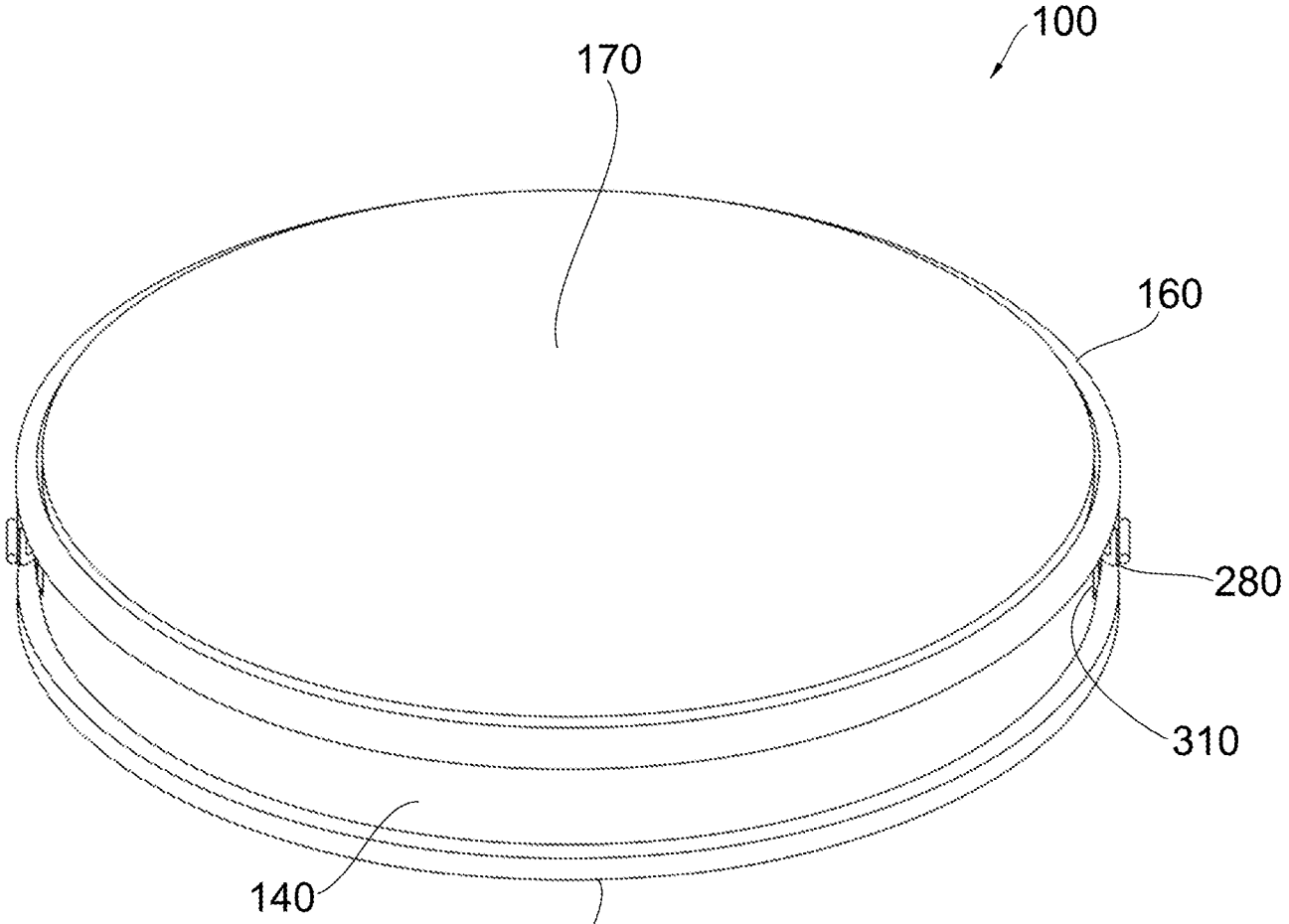
FIG. 14 is a perspective view of an assembled selectively weighted fitness slider according to a second embodiment.

FIG. 14 illustrates a second embodiment of a selectively weighted fitness slider 100. The selectively weighted fitness slider 100 is shown in an assembled state. The selectively weighted fitness slider 100 is formed of a base 120 including an outer wall 140 extending from the base 120, and a top part 160 that is releasably attachable to the outer wall 140 of the base 120. The base 120, outer wall 140 and the top part 160 may be formed of thermoplastic polymer material, such as high density polyethylene (HDPE) or another suitable polymer material. However, the base 120, outer wall 140 and the top part 160, are not limited to being formed of this material, and in other embodiments may be formed of resin, polyamide (e.g., nylon), polycarbonate (e.g., BPA), polypropylene or polyethylene. In further embodiments, the base 120, outer wall 140 and the top part 160 may be formed of a light-weight hard plastic material made from Acrylonitrile butadiene styrene (ABS) that facilitates the sliding motion against a surface of wood, fiber, ceramic, plastic, metal, concrete, stone, or a synthesize composite. The top part 160 may include a foam material 170 on the outer surface of the top part 160. The foam material 170 may be formed of natural or synthetic fabric, or any other suitable soft material, that acts as a buffer for sliding on tile or wood floors so that the selectively weighted fitness slider 100 glides smoothly across the tile or wood floor without scratching the surface. Meanwhile, the thermoplastic polymer material of the base 120 (without the foam) allows for easy sliding on grass, turf, carpet, or other fiber flooring. FIG. 14 also shows that the top part 160 includes a hook 280 that engages with a recess in a port 310 on the outer wall 140 for releasably attaching the top part 160 to the base 120, as discussed in further detail below.

In the illustrated embodiment, the selectively weighted fitness slider 100 may have a substantially circular shape, such that the selectively weighted fitness slider 100 is substantially disc-shaped. However, other polygonal shapes (e.g., rectangular, pentagonal, hexagonal, etc.) are within the scope of the present disclosure, and other such shapes will not materially alter the function and purpose of the selectively weighted fitness slider 100. In one embodiment, the top part 160 may have a diameter of 9 inches and a thickness or height of 0.31 inches. The base 120 may have a diameter of 9 inches and a thickness or height of 0.31 inches. The outer wall 140 may have a height of 1.5 inches. However, the selectively weighted fitness slider 100 is not limited to these dimensions, and larger and smaller dimensions are within the scope of the present disclosure.

Figure 15:
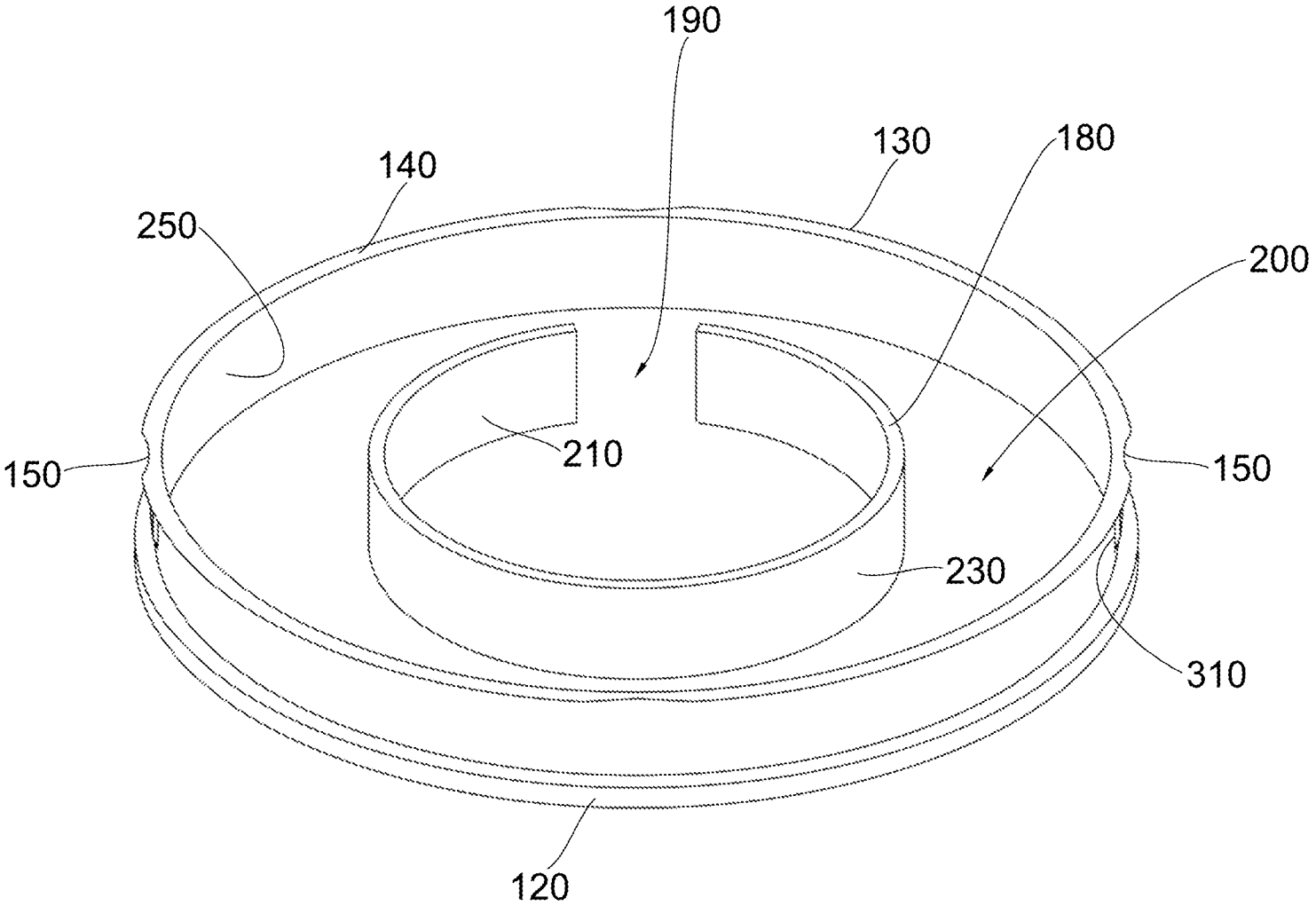
FIG. 15 is a perspective view of the base of the selectively weighted fitness slider according to the second embodiment.

FIG. 15 is a perspective view of the inner portion of the base 120 of the selectively weighted fitness slider 100 according to the second embodiment. In the illustrated embodiment, the outer wall 140 may include a lip 130 around the perimeter of the outer wall 140. Lateral recesses 150 may be provided at locations on the lip 130 which correspond to locations of the port 310 on the outer wall 140, so that the lateral recesses 150 provide passage for the hook 280 to the port 310 and recess 300 without being obstructed by the lip 130. FIG. 15 also shows that the base 120 and the outer wall 140 define an interior space 200 within the selectively weighted fitness slider 100 such that the interior space 200 is surrounded by the outer wall 140. The wall 140 includes an inner surface 250 facing the interior space 200. The base 120 also includes an inner wall 180 that is provided in the interior space 200 and that extends from the base 120 in the same manner (e.g., direction) as the outer wall 140. In the illustrated embodiment, the inner wall 180 includes an outside surface 230 facing the outer wall 140, and an opposing inside surface 210. The inner wall 180 may be provided with a gap 190, such that the inner wall 180 does not form a full circle. The inner wall 180 may be formed of the same material as the base 120, outer wall 140 and the top part 160, and may have a diameter of 4.5 inches and a height of 1.5 inches. However, the inner wall 180 is not limited to these dimensions, and larger and smaller dimensions are within the scope of the present disclosure. The inner wall 180 is configured to releasably secure one or more weights (see FIGS. 17 to 19) within the interior space 200, in order to selectively increase or decrease the overall weight of the selectively weighted fitness slider 100, so as to increase or decrease the intensity and resistance of an exercise routine according to the individual person's needs or desires with respect to the exercise routine.

Figure 16:
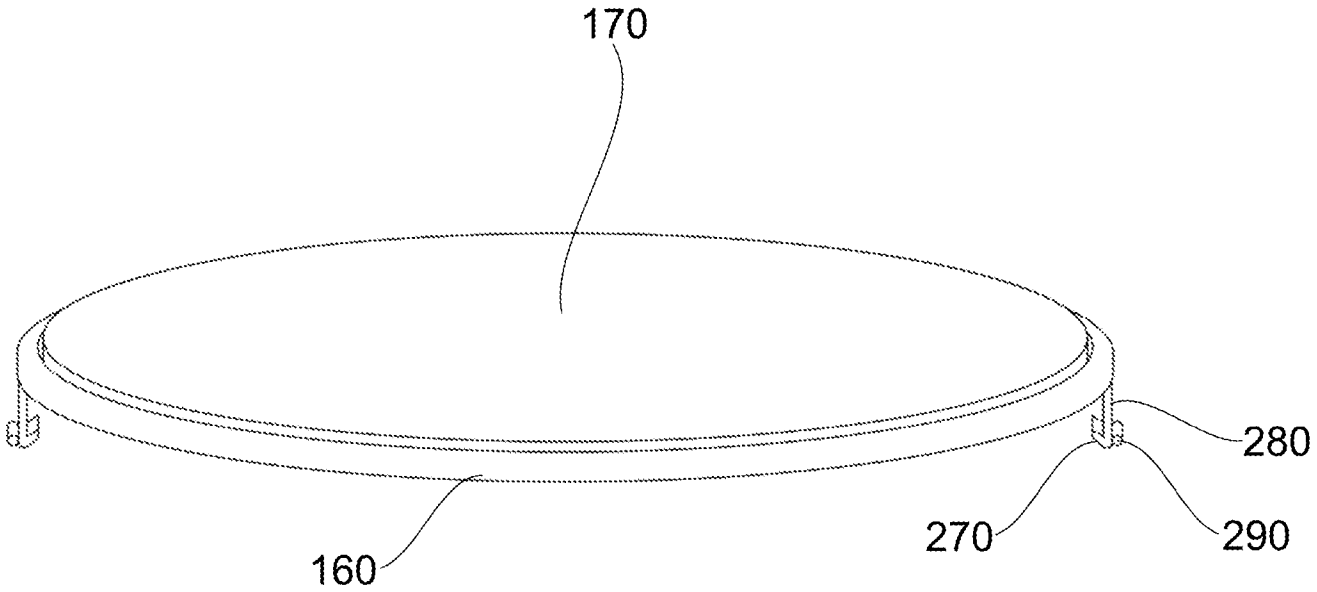
FIG. 16 is a perspective view of the top part of the selectively weighted fitness slider according to the second embodiment.

FIG. 16 illustrates an isolated perspective view of the top part 160 of the selectively weighted fitness slider 100. As discussed above, the top part 160 may include a foam material 170 on the outer surface of the top part 160, which acts as a buffer for sliding on tile or wood floors so that the selectively weighted fitness slider 100 glides smoothly across the tile or wood floor without scratching the surface. At least two opposing edges of the top part 160 may include a hook 280 that is configured to engage with a recess 300 in a port 310 on the outer wall 140 for releasably attaching the top part 160 to the base 120, as discussed in further detail below. The hook 280 may extend from the side or bottom of the top part 160, and includes a tip 270 that catches the recess 300 after insertion of the hook 280 into the recess. The hook 280 may also include a knob 290 that is configured to be gripped by the fingers and thumb of a person to pull or push the hook 280 inward and outward for attaching and detaching, respectively, the top part 160 to the base 120. The hook 280 may be formed of the same material as the top part 160, the base 120, or outer wall 140.

Figure 17:
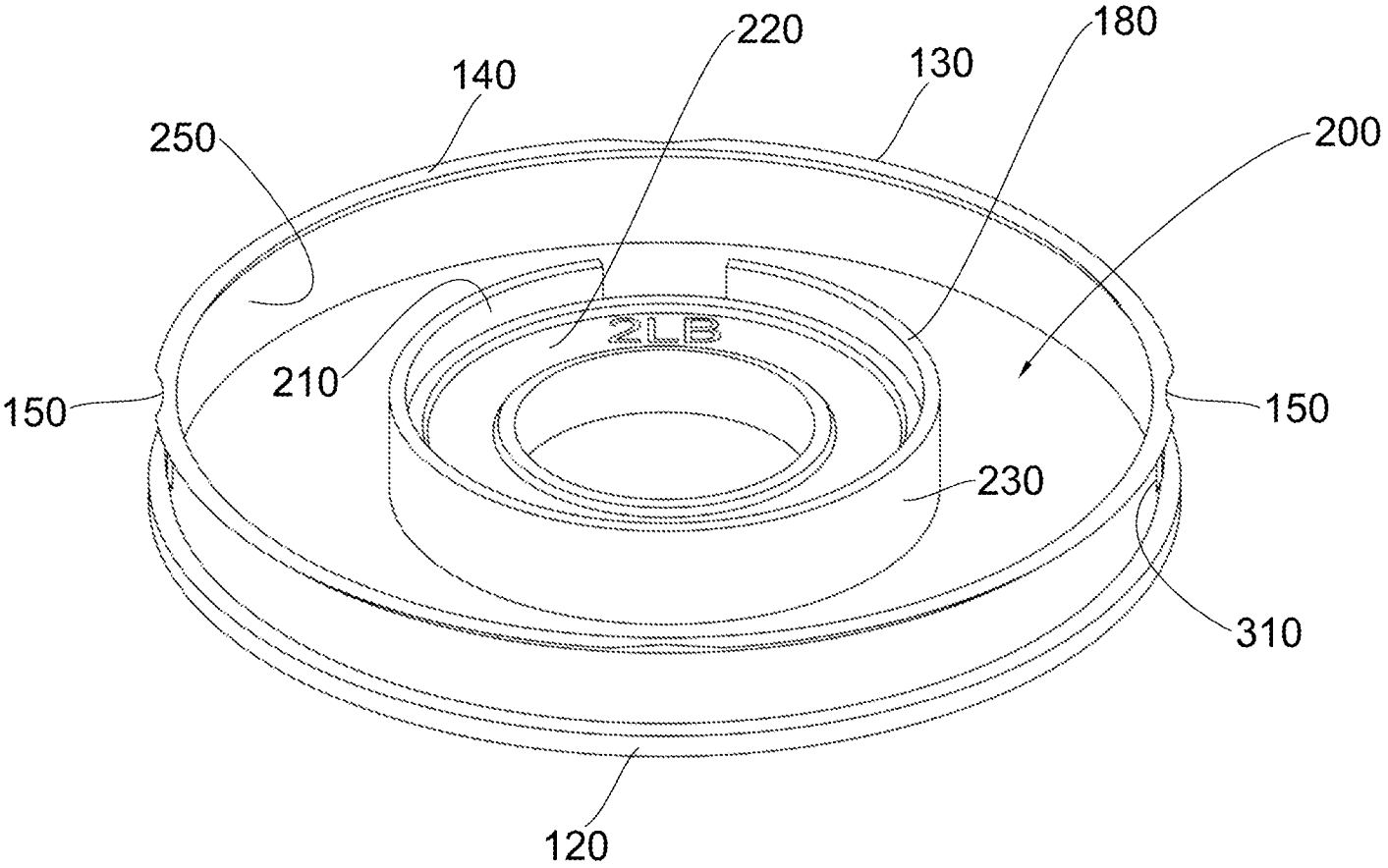
FIG. 17 is a perspective view of the base of the selectively weighted fitness slider including a first weight, according to the second embodiment.

FIG. 17 is a perspective view of the inner portion of the base 120 showing a first weight 220 provided in the interior space 200. In this case, the first weight 220 is located inside the inner wall 180, so as to be secured within the interior space 200 via contact with the inside surface 210 of the inner wall 180. That is, the first weight 220 is secured from moving within the interior space 204) by being confined by the inside surface 210 of the inner wall 180. The first weight 220 may be a 2 pound weight that can be placed within the base 120 to increase the overall weight of the selectively weighted fitness slider 100, so as to increase the intensity and resistance of an exercise routine according to the individual person's needs or desires with respect to the exercise routine. The gap 190 in the inner wall 18 may provide a space for a person's fingers and thumb to insert or retrieve the first weight 220 to or from the area inside the inner wall 180. The first weight 220 may be a ring-shaped plate with an circular opening in the center thereof.

Figure 18:
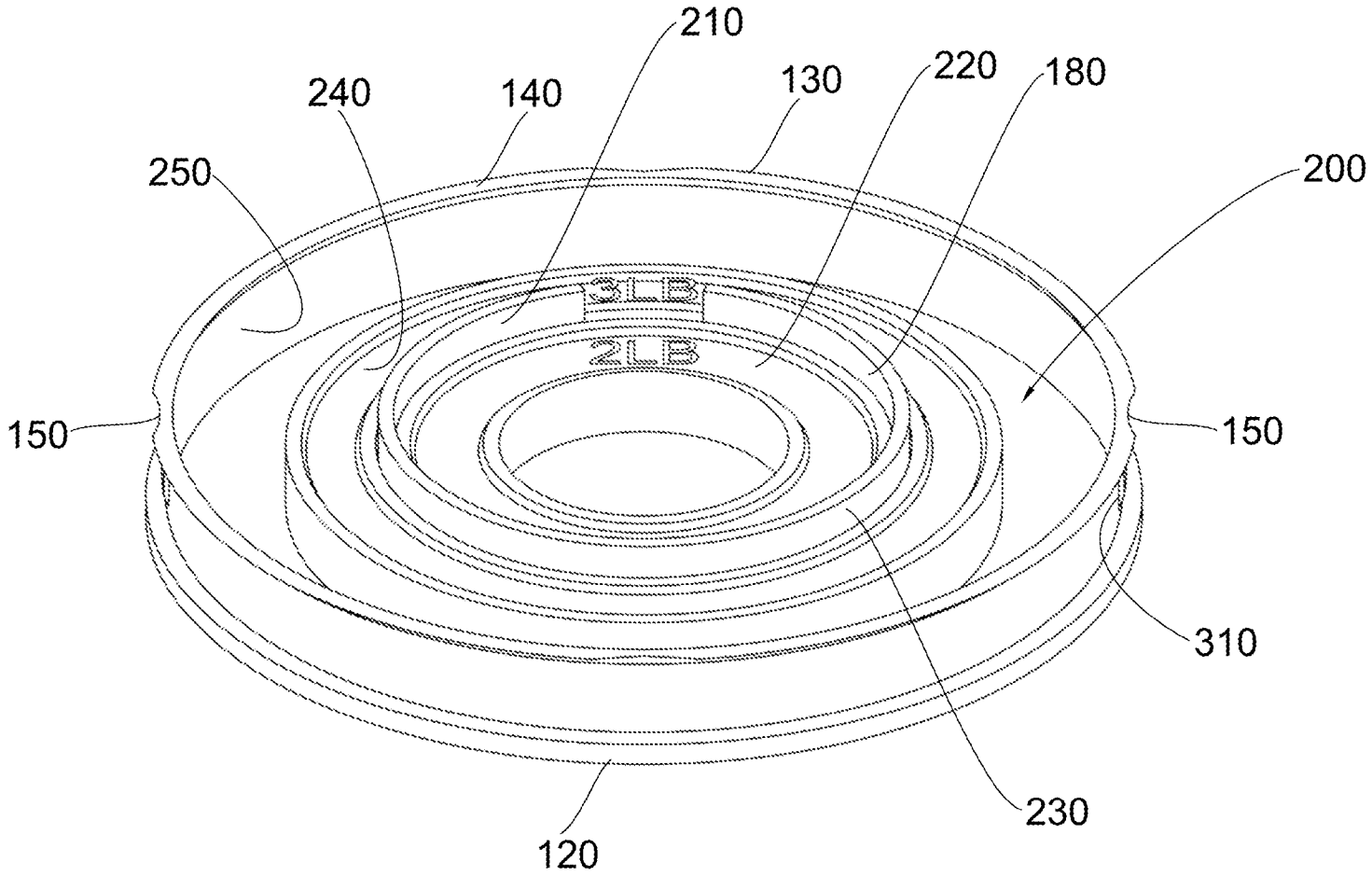
FIG. 18 is a perspective view of the base of the selectively weighted fitness slider including a first weight and a second weight, according to the second embodiment.

FIG. 18 is another perspective view of the inner portion of the base 120. This view shows a second weight 240 provided in the interior space 200 in addition to the first weight 220. The second weight 240 is located outside the inner wall 180, so as to be secured within the interior space 200 via contact with the outside surface 230 of the inner wall 180. That is, the second weight 240 may be a ring-shaped plate with a circular opening in the center thereof, so as to be secured from moving within the interior space 200 via contact of the circular opening with the outside surface 230 of the inner wall 180. The second weight 240 may be a 3 pound weight that can be used by itself, or in addition with the 2 pound first weight 220, to increase the overall weight of the selectively weighted fitness slider 100. For instance, adding the 3 pound second weight 240 by itself would add three pounds to the overall weight of the selectively weighted fitness slider 100, while adding the 3 pound second weight 240 with the 2 pound first weight 220 would add five pounds to the overall weight of the selectively weighted fitness slider 100. Either combination can increase the intensity and resistance of an exercise routine according to the individual person's needs or desires with respect to the exercise routine.

Figure 19:
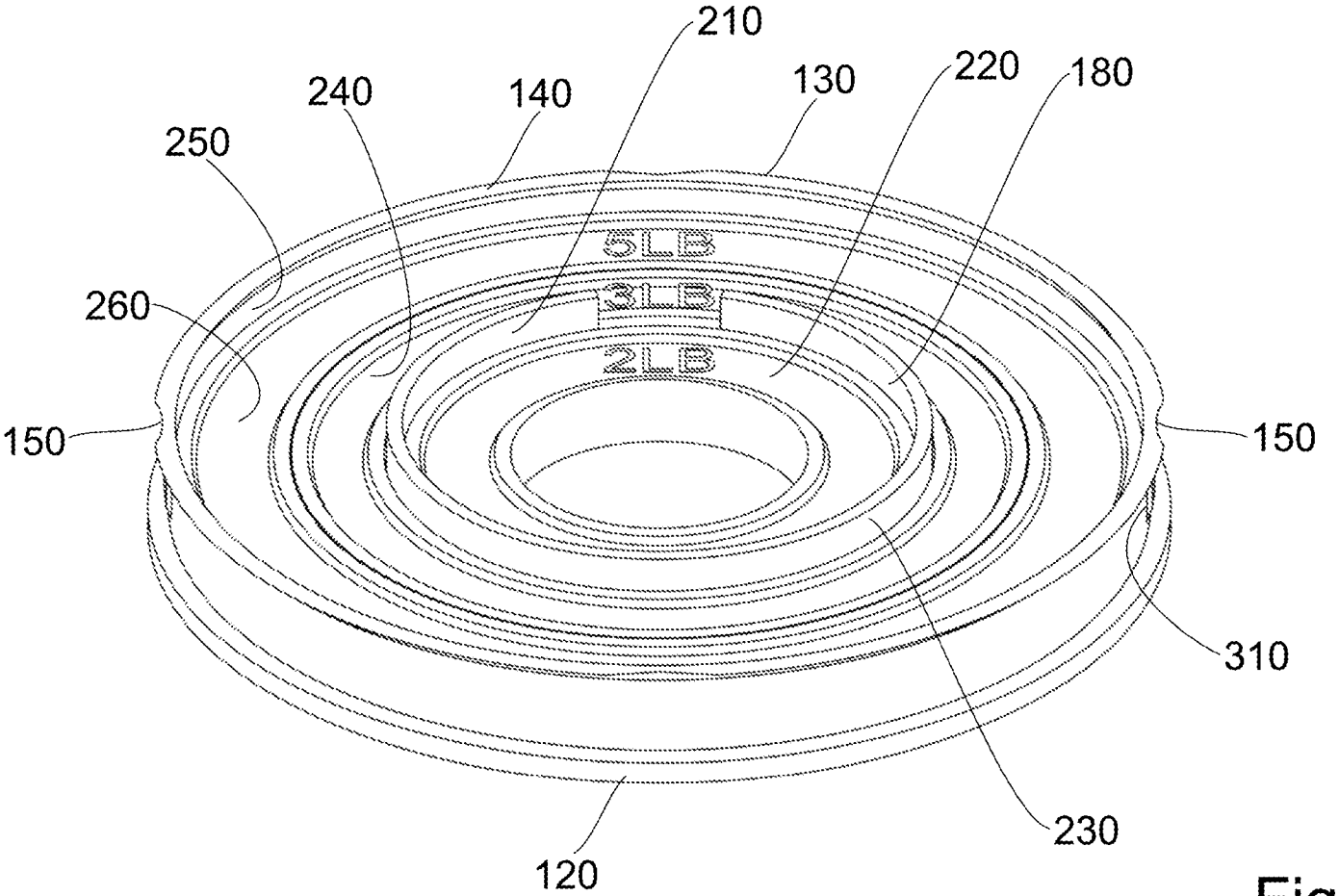
FIG. 19 is a perspective view of the base of the selectively weighted fitness slider including a first weight, and second weight, and a third weight, according to the second embodiment.

FIG. 19 is a further perspective view of the inner portion of the base 120. This view shows a third weight 260 provided in the interior space 200 in addition to the first weight 220 and the second weight 240. The third weight 260 is located within the interior space 200 to surround the second weight 240, and may be secured in within the interior space 200 via contact with the inner surface 250 of the outer wall 140 and/or the outside surface of the second weight 240. In this regard, the third weight 260 may be a ring-shaped plate with a circular opening in the center thereof, so as to surround the second weight 240 within the circular opening when used in combination with the second weight 240. The third weight 260 may be a 5 pound weight that can be used by itself, or in addition with the 3 pound second weight 240 and/or 2 pound first weight 220, to increase the overall weight of the selectively weighted fitness slider 100. For instance, adding the 5 pound third weight 240 by itself would add five pounds to the overall weight of the selectively weighted fitness slider 100. In this case, the third weight 260 would be secured in within the interior space 200 via contact with the inner surface 250 of the outer wall 140. Adding the 5 pound third weight 260 with the 3 pound second weight 240 would add eight pounds to the overall weight of the selectively weighted fitness slider 100. Adding the 5 pound third weight 260 with the 3 pound second weight 240 and the 2 pound first weight 220 would add ten pounds to the overall weight of the selectively weighted fitness slider 100. On the other hand, adding the 5 pound third weight 260 with the 2 pound first weight 220 would add seven pounds to the overall weight of the selectively weighted fitness slider 100. Any of these possible combinations can increase the intensity and resistance of an exercise routine according to the individual person's needs or desires with respect to the exercise routine. The material of the third weight 260, the second weight 240 and the first weight 220 is not particularly limiting, and in some embodiments may be iron, cast iron, or other metal. In some embodiments, the weights may be coated with a coating, such as a polyvinyl chloride sheath.

Figure 20:
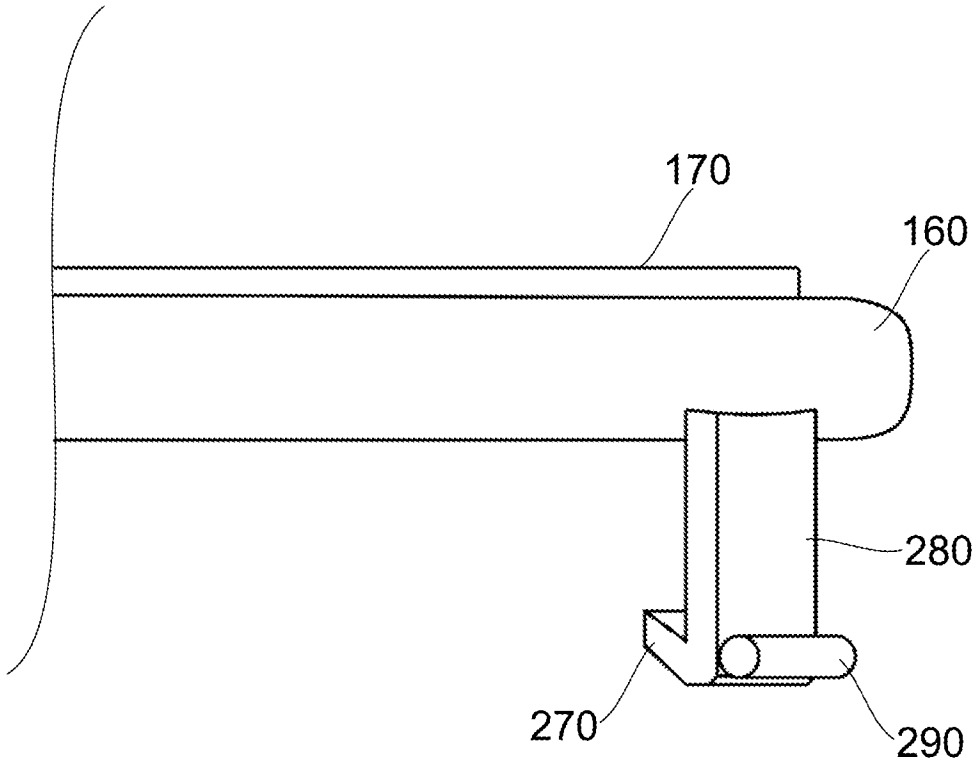
FIG. 20 is a partial side view of the top part and a hook thereof of a selectively weighted fitness slider according to the second embodiment.

FIG. 20 illustrates a partial side view of the top part 160 and the hook 280 if the selectively weighted fitness slider 100 according to the second embodiment. As discussed above, the hook 280 may extend from the side or bottom of the top part 160, and includes a tip 270 that is configured to catch the recess 300 of a port 310 on the outer wall 140 of the base 120 (see FIGS. 21 and 22). The hook 280 may also include a knob 290 that is configured to be gripped by the fingers and thumb of a person to pull or push the hook 280 inward and outward for attaching and detaching, respectively, the top part 160 to the base 120. The selectively weighted fitness slider 100 may include two or more hooks 280 located at positions around the perimeter of the top part 160, and the outer wall 140 of the base 120, may include the same number of ports 310 with a recess 300 at corresponding locations around the perimeter of the outer wall 140. The size and shape of the hook 280 is not limited to any particular size and shape, so long as the hook 280 is able to enter and exit the recess 300 releasably attach the top part 160 to the outer wall 140 to provide an assembled selectively weighted fitness slider 100.

Figure 21:
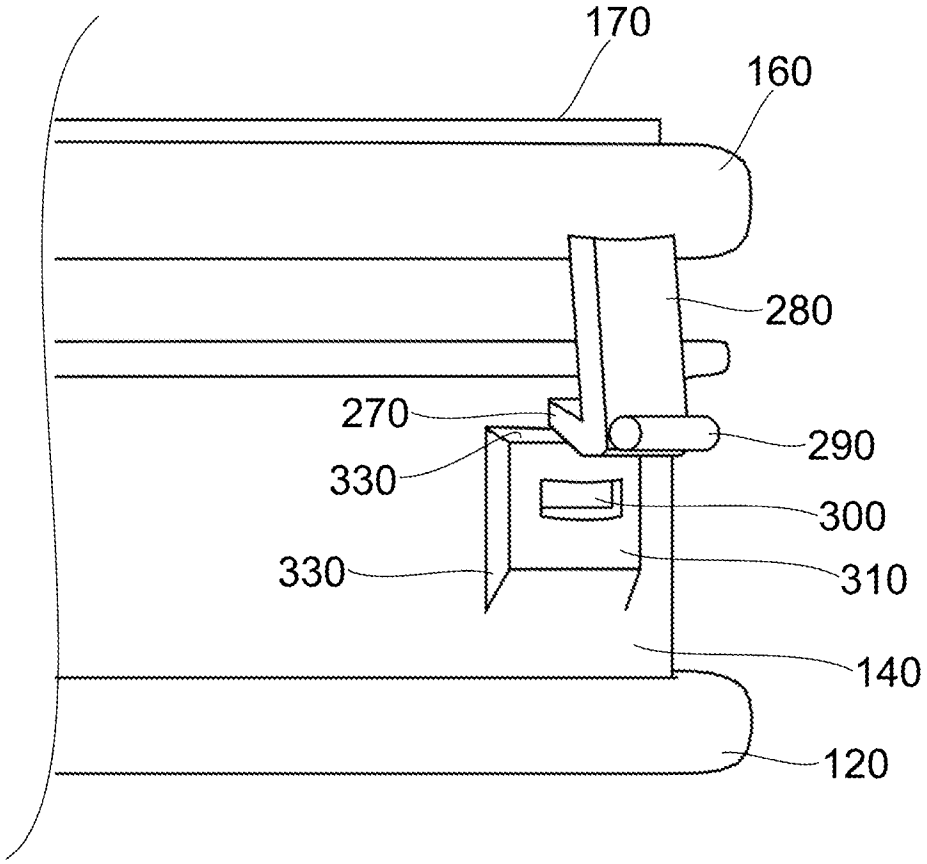
FIG. 21 is a partial side view of the hook of FIG. 20 before engagement of the hook with a recess in the outer wall of the base of the selectively weighted fitness slider according to the second embodiment.
Figure 22:
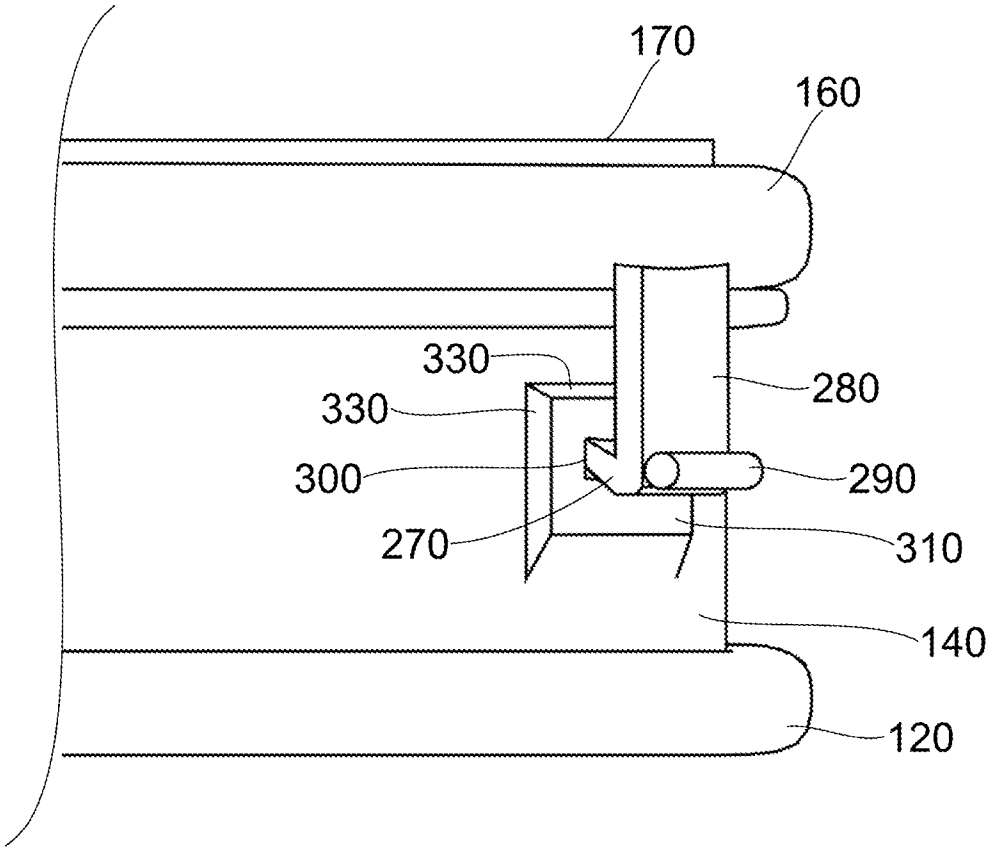
FIG. 22 is a partial side view of the hook of FIG. 20 engaged with the recess of FIG. 21 according to the second embodiment.

FIG. 21 is a partial side view of the hook 280 and the recess 300 in the outer wall 140 before engagement of the hook 280 with the recess 300, according to the second embodiment. FIG. 21 shows that to releasably attach the top part 160 of the selectively weighted fitness slider 100 to the outer wall 140, the hook 280 should first be aligned with the port 310, so that downward motion of the top part 160 brings the hook 280 close to the recess 300 in the port 310. In the embodiment of FIG. 21, the port 310 protrudes from the surface of the outer wall via inclined walls 330. The top inclined wall 330 may engage with the tip 270 of the hook 280 to move the tip 270 and/or hook 280 radially outward before entering the recess 300. Further downward movement of the top part 160 relative to the base 120 brings the tip 270 to the recess 300 where the tip 270 and/or hook 280 snaps radially inward to insert the tip 270 into the recess 300 and releasably attach the top part 160 to the outer wall 140, as shown in FIG. 22.

A method of assembling a selectively weighted fitness slider 100 may include inserting a weight 220, 240 into the interior space 200 that is defined by the base 120 and the outer wall 140 extending from the base 120, as discussed herein. The weight 220, 240 may be releasably secured to the inner wall 180 that is provided in the interior space 200 and that extends from the base 120, by positioning the weight 220, 240 adjacent to one of the inside surface 210 of the inner wall 180 and an outside surface 230 of the inner wall 180, as discussed herein. Or, a weight 260 may be releasably secured to the outer wall 140 by positioning the weight 260 adjacent to the inner surface 250 of the outer wall 140, as discussed herein. The top part 160 of the selectively weighted fitness slider 100 may then be releasably attached to the outer wall 140 to enclose the interior space 200, as discussed herein. The method may include positioning a first weight 220 adjacent to the inside surface 210 of the outer wall 140, and positioning a second weight 240 adjacent to the outside surface 230 of the inner wall 180 to releasably secure the first and second weights 220, 240 to the inner wall 180, as discussed herein. The method may also include positioning a third weight 260 in the interior space 200 to surround the second weight 240, as discussed herein. The method may further include releasably attaching the top part 160 of the selectively weighted fitness slider 100 to the outer wall 140 by inserting the hook 280 of the top part 160 into the recess 300 on the outer wall 140, as discussed herein.

In some embodiments, the selectively weighted fitness slider 100 may be provided as a kit that includes the selectively weighted fitness slider 100 as discussed herein along with the first, second and third weights 220, 240, 260 that are configured to be releasably secured within the interior space 200 of the selectively weighted fitness slider 100, as discussed herein. A person may use the first, second and third weights 220, 240, 260 with the selectively weighted fitness slider 100 in any of the different weight combinations as discussed herein to increase the intensity and resistance of an exercise routine according to the individual person's needs or desires with respect to the exercise routine.

It should be understood that the foregoing description provides embodiments of the present invention which can be varied and combined without departing from the spirit of this disclosure. Although several embodiments have been illustrated in the accompanying drawings and describe in the foregoing specification, it will be understood by those of skill in the art that additional embodiments, modifications and alterations may be constructed from the principles disclosed herein. Those skilled in the art should, in light of the present disclosure, appreciate that many changes can be made in the specific embodiments which are disclosed and still obtain a like or similar result without departing from the concept, spirit and scope of the present disclosure.

What is claimed is:

1. A fitness slider comprising:
a base;
an interior space within the base;
an inner wall provided in the interior space and extending from the base;
a first weight inside the inner wall, and a second weight outside of the inner wall;
a third weight surrounding the second weight;
a top part that is releasably attached to the base; and
wherein the inner wall is configured to releasably secure the first weight and the second weight within the interior space.

2. The fitness slider of claim 1, further comprising:
a locking band that encircles the base and the top part to releasably secure the base and the top part together.

3. The fitness slider of claim 1, wherein, the first weight and the second weight are secured by the inner wall.

4. The fitness slider of claim 1, wherein the inner wall is configured to secure the second weight via an inside surface of the inner wall.

5. The fitness slider of claim 1, wherein the inner wall is configured to secure the third weight via an outside surface of the inner wall.

6. The fitness slider of claim 1, further comprising:
a foam material on an outer surface of the top part.

7. A method of assembling a fitness slider, comprising:
inserting a first weight into an interior space of a base of the fitness slider;
releasably securing the first weight to an inner wall that is provided in the interior space and that extends from the base, by positioning the first weight adjacent an inside surface of the inner wall;
positioning a second weight adjacent an outside surface of the inner wall;
positioning a third weight in the interior space to surround the second weight; and
releasably attaching a top part of the fitness slider to the base to enclose the interior space.

8. The method of claim 7, comprising positioning the weights adjacent to the inside surface of the inner wall.

9. The method of claim 8, further comprising positioning the second weight adjacent to the outside surface of the inner wall to releasably secure the second weight to the inner wall.

10. The method of claim 9, further comprising positioning the third weight in the interior space to surround the second weight.

11. The method of claim 8, further comprising positioning the second weight in the interior space adjacent to an inside surface of a shoulder of the base.

12. The method of claim 7, comprising releasably securing the top part of the fitness slider to the base by encircling the base and the top part with a locking band.

13. A fitness kit comprising:
a fitness slider comprising:
a base;
an interior space within the base;
an inner wall provided in the interior space and extending from the base;
a top part that is releasably attachable to the base;
a locking band that encircles the base and the top part to releasably secure the base and the top part together;
one or more weights configured to be releasably secured within the interior space of the fitness slider,
a first one of the one or more weights configured to fit inside the inner wall, and a second one of the one or more weights configured to fit outside of the inner wall;
a third one of the one or more weights configured to surround the second weight; and
wherein the inner wall of the slider is configured to releasably secure at least one of the one or more weights via contact with one of an outside surface of the inner wall and an inside surface of the inner wall.

14. The fitness kit of claim 13, wherein an inner surface of a shoulder of the base is configured to releasably secure one of the one or more weights via contact with an inner surface of the shoulder.

* * * * *